US008314320B2

(12) United States Patent
Okuda

(10) Patent No.: US 8,314,320 B2
(45) Date of Patent: Nov. 20, 2012

(54) AUTOMATIC ACCOMPANYING APPARATUS AND COMPUTER READABLE STORING MEDIUM

(75) Inventor: Hiroko Okuda, Kokubunji (JP)

(73) Assignee: Casio Computer Co., Ltd., Tokyo (JP)

( * ) Notice: Subject to any disclaimer, the term of this patent is extended or adjusted under 35 U.S.C. 154(b) by 114 days.

(21) Appl. No.: 13/012,091

(22) Filed: Jan. 24, 2011

(65) Prior Publication Data

US 2011/0185881 A1 Aug. 4, 2011

(30) Foreign Application Priority Data

Feb. 4, 2010 (JP) ..... 2010-022737

(51) Int. Cl.
*G10H 1/36* (2006.01)

(52) U.S. Cl. ..... 84/610; 84/609; 84/634; 84/649; 84/650; 84/666

(58) Field of Classification Search ..... None
See application file for complete search history.

(56) References Cited

U.S. PATENT DOCUMENTS 5,296,644 A 3/1994 Aoki
5,539,146 A * 7/1996 Tohgi ..... 84/650
6,124,543 A * 9/2000 Aoki ..... 84/609
6,162,982 A * 12/2000 Aoki ..... 84/611
7,582,824 B2 * 9/2009 Sumita ..... 84/612
8,097,801 B2 * 1/2012 Gannon ..... 84/613
2001/0047717 A1 * 12/2001 Aoki et al. ..... 84/611
2008/0236364 A1 * 10/2008 Fujishima et al. ..... 84/601
2009/0031884 A1 * 2/2009 Arai et al. ..... 84/609
2012/0137855 A1 * 6/2012 Gannon ..... 84/613

* cited by examiner

*Primary Examiner* — Marlo Fletcher

(74) *Attorney, Agent, or Firm* — Turocy & Watson, LLP

(57) ABSTRACT

CPU 21 decides a current melody tone CM relating to a key depressed at a the leading position of a current beat and a previous melody tone PM relating to a key depressed at the leading position of a beat coming directly before the current beat, based on time information, in particular, beat information, controlling progress of automatic accompanying data in operation in a melody sequence progressing in response to manipulation of a keyboard 11. Further, CPU 21 performs a chord name deciding process to decide a current chord name, based on the decided current melody tone, previous melody tone, and a previous chord name PreCH, or a chord name at the previous beat. When deciding a melody tone, CPU 21 decides the current melody tone CM and the previous melody tone PM based on what number the current beat is in a measure.

10 Claims, 28 Drawing Sheets

FIG. 22

2200

| | CM | | | | | | | | |
|---|---|---|---|---|---|---|---|---|---|
| | C | D | E | F | G | A♭ | A | B |
| C | C C | C D | C E | C F | C G | C A♭ | C A | C B |
| D | D C | D D | D E | D F | D G | D A♭ | D A | D B |
| E | E C | E D | E E | E F | E G | E A♭ | E A | E B |
| F | F C | F D | F E | F F | F G | F A♭ | F A | F B |
| G | G C | G D | G E | G F | G G | G A♭ | G A | G B |
| A♭ | A♭ C | A♭ D | A♭ E | A♭ F | A♭ G | A♭ A♭ | A♭ A | A♭ B |
| A | A C | A D | A E | A F | A G | A A♭ | A A | A B |
| B | B C | B D | B E | B F | B G | B A♭ | B A | B B |

PM

FIG. 23

2310 2311 2301 2302 2322 2321 2300

| PREVIOUS CHORD FUNCTION | SORT | C D | C E | C F | C G | C A♭ | C A | C B | ····· |
|---|---|---|---|---|---|---|---|---|---|
| TO | | V Major | I Major | IV Major | I Major | IVm | IV Major | V Major | ····· |
| | jump 1 | V Major | I Major | IV Major | I Major | IVm | IV Major | V Major | ····· |
| | jump 2 | IIm | IIIm | IV Major | V Major | III7 | IV Major | IIIm | ····· |
| SU | | IIm7 | I Major | IV Major | I Major | IVm | IV Major | V Major | ····· |
| | jump 1 | IIm7 | I Major | IIm | I Major | IVm | IIm | V Major | ····· |
| | jump 2 | V7 | VIm | V Major | V Major | III7 | IIm7 | IIIm | ····· |
| DO | | V Major | I Major | V Major | I Major | IVm | VIm | I Major | ····· |
| | jump 1 | V Major | I Major | IIm | I Major | IVm | VIm | I Major | ····· |
| | jump 2 | I Major | VIm | IV Major | IIIm | IVm | IV Major | VIm | ····· |

FIG. 24

2400

| PREVIOUS CHORD FUNCTION | C D | C E | C F | C G | C A♭ | C A | C B |
|---|---|---|---|---|---|---|---|
| TO | IIm7 | I Major | IV Major | I Major | IVm | IV Major | IM7 |
| SU | IIm7 | I Major | IV Major | V Major | IVm | IV Major | V Major |
| DO | V Major | I Major | IV Major | I Major | IVm | VIm | I Major |

2410 2401 2402 2421

FIG. 25

2500

CM

| PreCH | C | C# | D | E♭ | E | F | F# | G | A♭ | A | B♭ | B |
|---|---|---|---|---|---|---|---|---|---|---|---|---|
| I Major | CT | | SN | | CT | SN | | CT | | SN | | SN |
| IM7 | CT | | SN | | CT | SN | | CT | | SN | | CT |
| IIm | SN | | CT | | SN | CT | | SN | | SN | | SN |
| IIm7 | CT | | CT | | SN | CT | | SN | | CT | | SN |
| IIm7-5 | CT | | CT | | SN | CT | | SN | CT | | SN | |
| .... | .... | .... | .... | .... | .... | .... | .... | .... | .... | .... | .... | .... |
| III Major | SN | | SN | | CT | | SN | | CT | SN | | CT |
| III7 | SN | | CT | | CT | SN | | | CT | SN | | CT |
| III7sus4 | SN | | CT | | CT | SN | | | SN | CT | | CT |
| .... | .... | .... | .... | .... | .... | .... | .... | .... | .... | .... | .... | .... |

2502 2512 2503 2501 2513 2522 2511 2521

FIG. 26

2600

CM

| PreCH | C | C# | D | E♭ | E | F | F# | G | A♭ | A | B♭ | B |
|---|---|---|---|---|---|---|---|---|---|---|---|---|
| I Major | | dim | | dim | | | dim | | aug | | aug | |
| IM7 | | dim | | aug | | | aug | | aug | | dim | |
| IIm | | aug | | dim | | | dim | | dim | | aug | |
| IIm7 | | aug | | dim | | | dim | | dim | | aug | |
| ... | ... | ... | ... | ... | ... | ... | ... | ... | ... | ... | ... | ... |

2601 2611 2612

AUTOMATIC ACCOMPANYING APPARATUS AND COMPUTER READABLE STORING MEDIUM

CROSS REFERENCE OF RELATED APPLICATIONS

The present application is based upon and claims the benefit of priority from the prior Japanese Application No. 2010-100423, file on Apr. 17, 2009, Japanese Patent Application No. 2010-22737, filed on Feb. 4, 2010, and the entire contents of which are incorporated herein by reference.

BACKGROUND OF THE INVENTION

1. Field of the Invention

The present invention relates to an automatic accompanying apparatus and a computer readable storing medium.

2. Description of the Related Art

It is general for players to play the electronic musical instrument having a keyboard with right hand mainly for a melody and with left hand mainly for an accompaniment in a similar manner when they play the piano and/or organ. When playing the piano, the player moves his or her right hand independently from left hand and vice versa, in accordance with a musical score. Therefore, he or she needs much practice. When playing the organ, the player is required to correctly depress plural keys composing a chord with his or her left hand. The player is also required to practice playing the organ.

When playing the piano or organ, the player is required to have practice in a proper way in moving his or her right hand and left hand at the same time. In particular, although the player can play a melody with his or her right hand, he or she feels difficulty in moving his or her left hand to depress keys. Particularly, many beginner feels so. Therefore, such electronic musical instruments are required that a player uses to play a melody with his or her right hand and meanwhile that automatically generates and plays an accompaniment to the melody.

For instance, U.S. Pat. No. 5,296,644 discloses an apparatus, in which data of musical notes in plural sections are stored, and when a chord name is given to a second section of musical notes, tonality data, data of musical notes in the second section, a chord name given to data of musical notes in the first section, and a chord name previously given to data of musical notes in the second section are referred, deciding a new chord name.

A melody tone is put different emphasis depending on the beats, and is also put different emphasis depending on temporal positions at which a key is depressed. Therefore, it is preferable to evaluate the emphasis to determine a chord name. Further, it is preferable to determine the chord name depending not only on a single melody tone but transition of plural melody tones.

SUMMARY OF THE INVENTION

The present invention has an object to provide an automatic accompanying apparatus, which can determine appropriate chord names depending on emphasis of melody tones and transition of the melody tones, and a computer readable storing medium.

According to one aspect of the invention, there is provided an automatic accompanying apparatus, which comprises storing means for storing automatic accompanying data, wherein the automatic accompanying data includes at least chord names and tone producing timings of chord composing tones based on time information containing beats, musical-tone generating means for generating musical-tone data of a musical piece, musical-tone data controlling means for controlling the musical-tone generating means in response to manipulation of a performance device, and chord name determining means for determining a chord name for generating musical tones in accordance with the automatic accompanying data, based on manipulation of the performance device, wherein the chord name determining means further comprises melody tone deciding means for deciding information of a current melody tone and information of a previous melody tone, based on time information for defining progression of the automatic accompanying data in operation in a melody sequence, which progresses in response to manipulation of the performance device, wherein the current melody tone relates a key depressed at a leading position of a current beat and the previous melody tone relates a key depressed at a leading position of a previous beat directly prior to the current beat, and chord name deciding means for deciding information of a current chord name based on the information of a current melody tone and the information of a previous melody tone, which have been decided by the melody tone deciding means, and information of a previous chord name at the previous beat, wherein the melody tone deciding means decides the information of a current melody tone and the information of a previous melody tone based on what number the current beat is in a measure.

According to another aspect of the invention, there is provided a computer readable recording medium to be mounted on an apparatus, wherein the apparatus is provided with a computer, a storing unit, which stores automatic accompanying data including at least chord names and tone producing timings of chord composing tones based on time information containing beats, and a musical-tone generating unit for generating musical-tone data of a musical piece, the recording medium storing a computer program, when executed, to make the computer perform the steps of musical-tone data controlling step of controlling the musical-tone generating unit in response to manipulation of a performance device, chord-name determining step of determining a chord name for producing musical tones in accordance with the automatic accompanying data, in response to manipulation of the performance device, wherein the chord-name determining step further comprises melody tone deciding step of deciding information of a current melody tone and information of a previous melody tone, based on time information for defining progression of the automatic accompanying data in operation in a melody sequence, which progresses in response to manipulation of the performance device, wherein the current melody tone relates a key depressed at a leading position of a current beat and the previous melody tone relates a key depressed at a leading position of a previous beat directly prior to the current beat, and chord-name deciding step of deciding information of a current chord name based on the information of a current melody tone and the information of a previous melody tone, decided in the melody tone deciding step, and information of a previous chord name at the previous beat, wherein in the melody tone deciding step, the information of a current melody tone and the information of a previous melody tone are decided based on what number the current beat is in a measure.

BRIEF DESCRIPTION OF THE DRAWINGS

FIG. 22 is a view showing an example of a melody sequence table in the present embodiment.

FIG. 23 is a view showing an example of a first chord table in the present embodiment.

FIG. 24 is a view showing an example of a second chord table in the present embodiment.

FIG. 25 is a view showing an example of a part of a melody function table used in the present embodiment.

FIG. 26 is a view showing an example of a part of a non-determination chord table in the present embodiment.

DETAILED DESCRIPTION OF THE PREFERRED EMBODIMENTS

Figure 1:
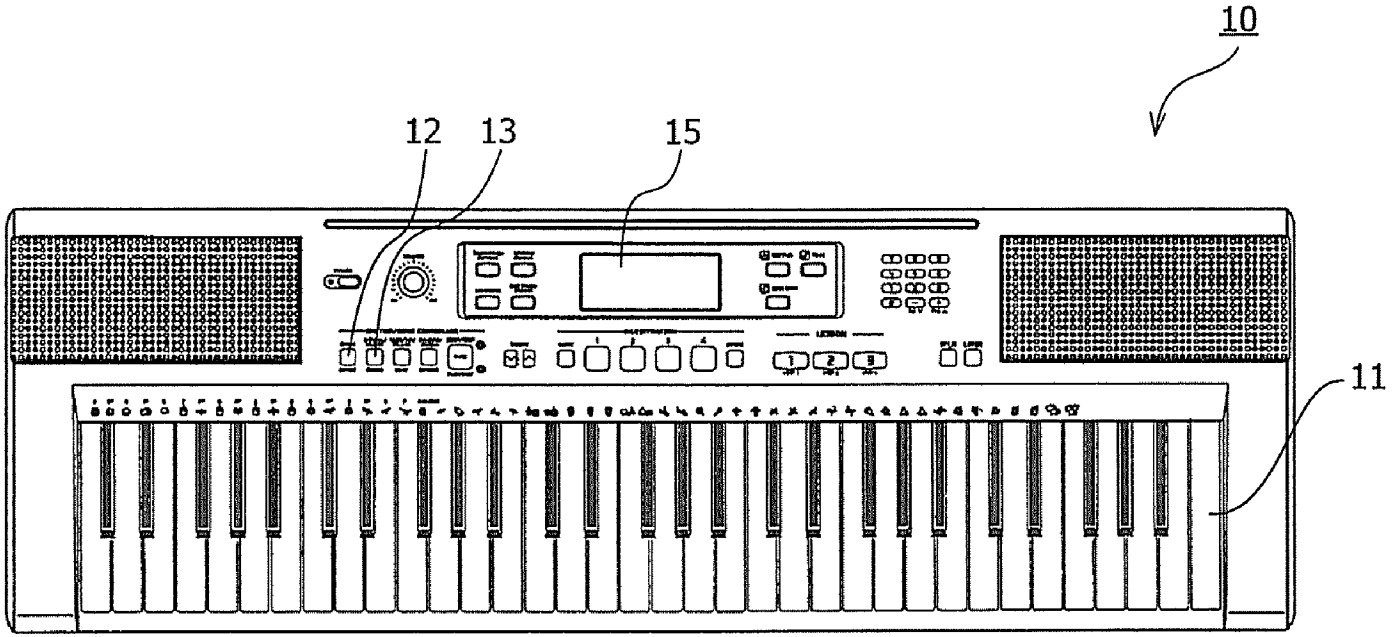
FIG. 1 is a view showing an external view of an electronic musical instrument according to an embodiment of the present invention.

Embodiments of the present invention will be described in details with reference to the accompanying drawings. FIG. 1 is a view showing an external view of an electronic musical instrument according to the embodiment of the invention. As shown in FIG. 1, the electronic musical instrument 10 according to the present embodiment has a keyboard 11. Further, the electronic musical instrument 10 has switches 12, 13, and a displaying unit 15 on the upper side of the keyboard 11. These switches 12, 13 are used to designate a timbre, start and/or termination of an automatic accompaniment, and a rhythm pattern. On the displaying unit 15 are displayed various sorts of information concerning a musical piece to be performed, such as timbre, rhythm patterns, and cord names. The electronic musical instrument 10 has two performance modes, one for putting on an automatic accompaniment and other for putting off the automatic accompaniment, and can perform in either one of the two performance modes.

Figure 2:
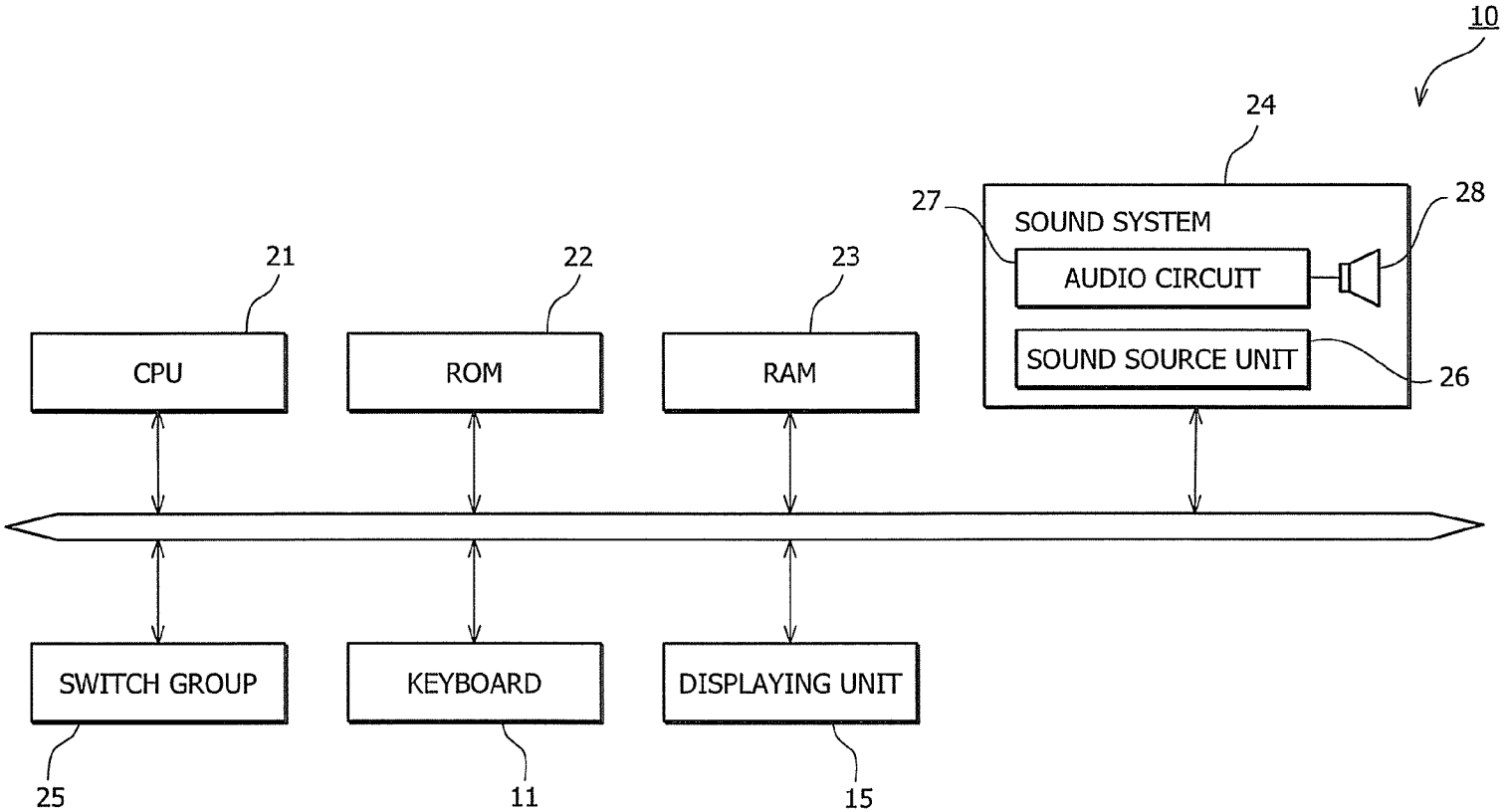
FIG. 2 is a block diagram showing a circuit configuration of the electronic musical instrument according to the present embodiment.

FIG. 2 is a block diagram showing a circuit configuration of the electronic musical instrument 10 according to the embodiment of the embodiment. As shown in FIG. 2, the electronic musical instrument 10 comprises CPU 21, ROM 22, RAM 23, a sound system 24, a switch group 25, the keyboard 11 and the displaying unit 15.

CPU 21 serves to perform various processes, including a process of controlling whole operation of the electronic musical instrument 10, a detecting process for detecting depressed keys of the keyboard 11 and operation of switches (for instance, 12 and 13 in FIG. 1) included in the switch group 25, a determining process for determining a chord name in accordance with a pitch of a musical tone corresponding to a depressed key, and automatic performance of accompaniment in accordance with automatic accompaniment patterns and chord names.

ROM 22 serves to store a program for CPU 21 to perform various processes, including, for instance, the detecting process for detecting operation of the switches and depressed keys of the keyboard 11, a tone generating process for generating musical tones corresponding to the depressed keys, the determining process for determining a chord name in accordance with a pitch of a musical tone corresponding to the depressed key, and the automatic performance of accompaniment in accordance with automatic accompaniment patterns and chord names. Further, ROM 22 has a waveform data area and an automatic accompaniment pattern area, wherein the waveform data area stores waveform data to be used to generate musical tones of piano, guitar, bass drum, snare drum and cymbal, and the automatic accompaniment pattern area stores data indicating various automatic accompaniment patterns. RAM 23 stores the program read from ROM 22 and data generated during the course of the process. In the present embodiment, the automatic accompaniment patterns have melody automatic accompaniment patterns including melody tones and obbligato tones, chord automatic accompaniment patterns including chord composing tones of each chord name, and rhythm patterns including drum sounds. For instance, a record of data of the melody automatic accompaniment patterns includes timbres, pitches, tone generating timings and tone durations of musical tones. A record of data of the chord automatic accompaniment patterns includes data indicating chord composing tones in addition to the above information. Data of the rhythm pattern includes timbres and tone generating timings of musical tones.

The sound system 24 comprises a sound source unit 26, audio circuit 27 and speaker 28. Upon receipt of information concerning depressed keys (depressed-key information) and/or information concerning automatic accompaniment patterns from CPU 21, the sound source unit 26 reads appropriate waveform data from the waveform area of ROM 22 and generates and outputs musical data of a certain pitch. Further, the sound source unit 26 can output as musical-tone data without any modification thereto, waveform data and in particular waveform data of timbres of percussion instruments such as bass drums, snare drums and cymbals. The audio circuit 27 converts musical-tone data (digital data) into analog data. The analog data converted and amplified by the audio circuit 27 is output through the speaker 28 as an acoustic signal.

The electronic musical instrument 10 according to the present embodiment generates musical tones in response to key depressing operation on the keyboard 11 by a player or user in a normal mode. Meanwhile, when an automatic accompaniment switch (not shown) is operated, the electronic musical instrument 10 can be switched from the normal mode to an automatic accompaniment mode. In the automatic accompaniment mode, in response to a key depressing operation is generated a musical tone of a pitch corresponding to a depressed key. Further, a chord name is determined based on the pitch of the depressed key, and musical tones are generated in accordance with the automatic accompaniment pattern including chord composing tones of the chord name. The automatic accompaniment pattern includes the melody automatic accompaniment pattern representing changes in pitch of piano and guitar, chord automatic accompaniment pattern, and rhythm pattern with no change in pitch of the bass drum, snare drum, and cymbal. Hereinafter, operation of the electronic musical instrument 10 in the automatic accompaniment mode will be described.

Figure 3:
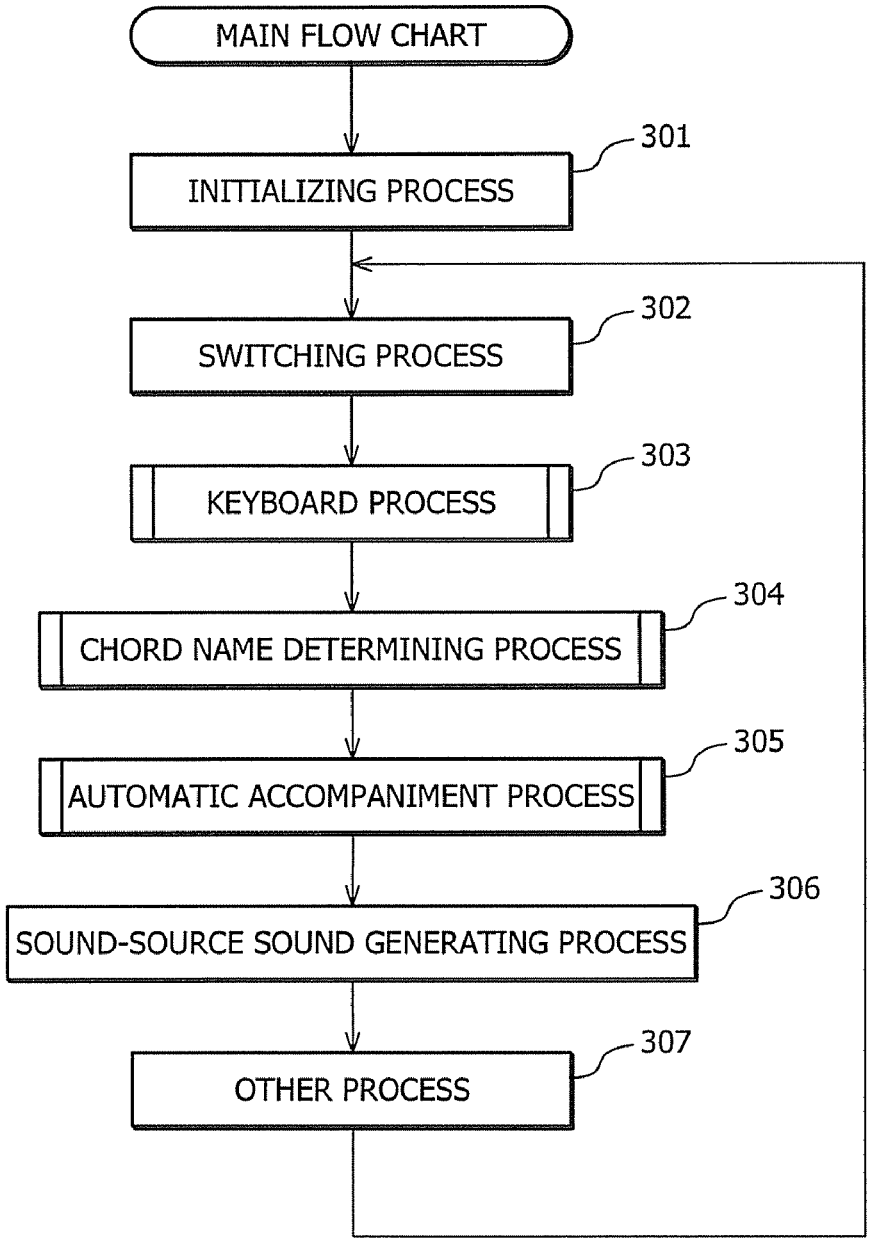
FIG. 3 is a flow chart of a main operation to be performed by the electronic musical instrument according to the present embodiment.

Now, the processes will be described in detail, which are to be performed by the electronic musical instrument 10 according to the present embodiment. FIG. 3 is a flow chart (main flow chart) of the operation to be performed by the electronic musical instrument 10 according to the present embodiment. While the operation is being performed in accordance with the main flow chart, a timer increment process is performed at a certain time interval to increment a counter value of an interruption counter.

When the power is turned on in the electronic musical instrument 10, CPU 21 performs an initializing process at step 301, clearing data in RAM 23 and an image on the displaying unit 15. After performing the initializing process at step 301, CPU 21 detects an operated state of each switch of the switch group 25, and performs switching processes in accordance with the detected operated states of the switches at step 302.

In the switching process at step 302, CPU 21 detects operations performed on various switches such as a timbre designating switch, a pattern designating switch, and an on-off designating switch. When the automatic accompaniment pattern has been turned "ON", CPU 21 switches the performance mode to the automatic accompaniment mode. Data indicating the performance mode can be designated at a certain area of RAM 23. Similarly, data indicating timbre and data indicating a sort of the automatic accompaniment patterns are also stored in a certain area of RAM 23.

Figure 4:
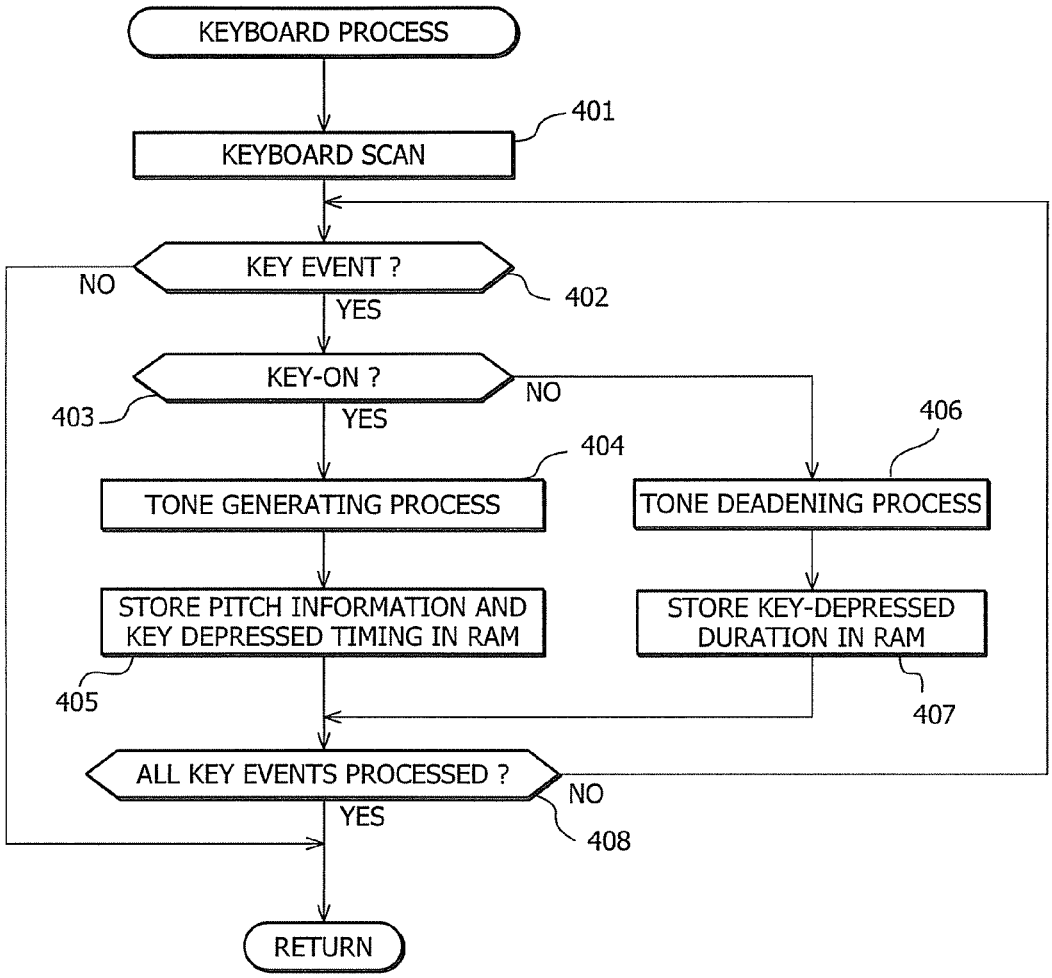
FIG. 4 is a flow chart of an example of a keyboard process performed in the present embodiment.

Then, CPU 21 performs a keyboard process at step 303. FIG. 4 is a flow chart of the keyboard process to be performed in the present embodiment. In the keyboard process, CPU 21 scans an operated state of the keyboard 11. The result of the scan of the keyboard 11 or a key event (key-on or key-off) is temporarily stored in RAM 22 together with information indicating a time at which such key event is caused. CPU 21 refers to the result of the scan of the keyboard 11 stored in RAM 23 at step 401, and judges at step 402 whether or not an event has occurred with respect to a key. When it is determined at step 402 that an even has occurred (YES at step 402), CPU 21 judges at step 403 whether the key event is "key-on" or not.

When it is determined at step 403 that the key event is "key-on" (YES at step 403), CPU 21 performs at step 404 the tone generating process with respect to a key at which the "key-on" has occurred. In the tone generating process, CPU 21 reads timbre data for melody keys and data indicating pitches of keys stored in ROM 22 and temporarily stores the read data in RAM 23. In a sound-source sound generating process to be described later (step 306 in FIG. 3), data indicating timbres and data indicating pitches are supplied to the sound source unit 26. The sound source unit 26 reads waveform data from ROM 22 in accordance with the data indicating timbres and pitches, and generates musical-tone data of a certain pitch, whereby a certain musical tone is output through the speaker 28.

Thereafter, CPU 21 stores in RAM 23 information concerning a pitch of a key at which "key-on" has occurred and a key depressing timing at step 405. The key depressing timing can be calculated based on the counter value of the interruption counter.

When it is determined at step 403 that the key event is not "key-on" (NO at step 403), the key event will be "key-off". Then, CPU 21 performs at step 406 a tone deadening process with respect to a key at which the "key-off" has occurred. In the tone deadening process, CPU 21 generates data indicating a pitch of a musical tone, whose sound is to be deadened, and temporarily stores the data in RAM 23. In this case, in the sound-source sound generating process (step 306 in FIG. 3), data indicating a timbre pitch of the musical tone, whose sound is to be deadened, is also supplied to the sound source unit 26. The sound source unit 26 deadens a tone of the musical tone based on the supplied data. Thereafter, CPU 21 stores in RAM 23 a time duration (key depressing time) during which the key is kept depressed (step 407).

CPU 21 judges at step 408 whether or not the process has been performed with respect to all the key events. When it is determined at step 408 that the process has not been performed with respect to all the key events (NO at step 408), CPU 21 returns to step 402.

Figure 5:
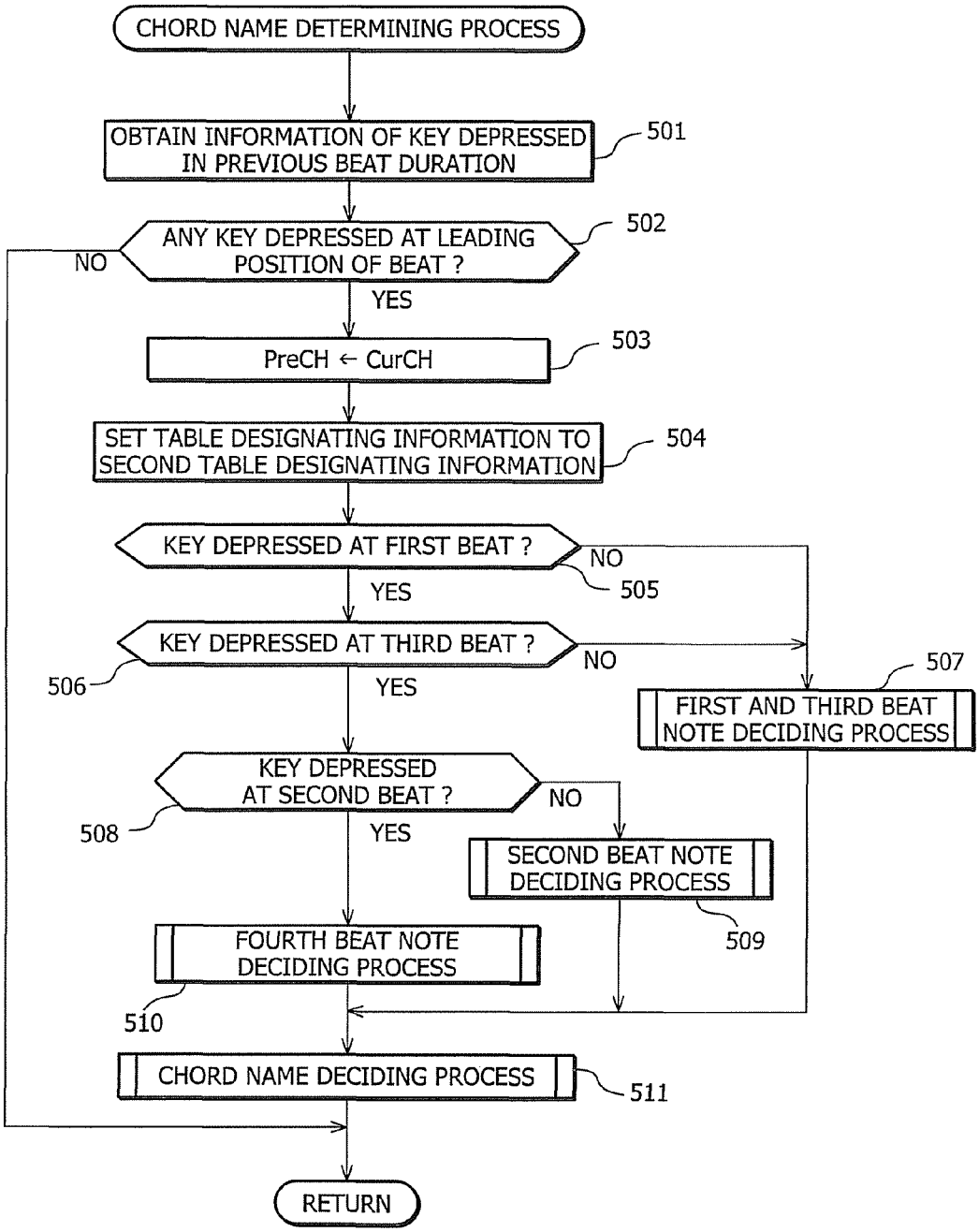
FIG. 5 is a flow chart of a chord name determining process to be performed in the present embodiment.

When the keyboard process has been finished (step 303 in FIG. 3), CPU 21 performs a chord name determining process at step 304. FIG. 5 is a flow chart of the chord name determining process to be performed in the present embodiment. In the present embodiment, a melody tone which is currently producing a sound is denoted by Current Melody tone CM, a melody tone which produces a sound just previously is denoted by Previous Melody tone PM, and a chord name which is previously performed is denoted by Previous Chord name PreCH. Then, Current Chord name CurCH which is to newly produce a sound is determined based on Current Melody tone CM, Previous Melody tone PM, and Previous Chord name PreCH. In the present embodiment, a tonality of the musical piece is set to C major (Cmaj) or A minor (Amin) and a chord name is represented by a degree corresponding to the tonic such as IMaj, IIm, and the related data is stored in RAM 23. In the case that the musical piece is set to a tonality other than C major (Cmaj) and/or A minor (Amin), a chord name with a root tone can be obtained based on a difference in pitch between the root tone of the set tonality and a tone of the tonality "C" or "A".

There is a case where Current Melody tone CM and/or Previous Melody tone PM should be decided based on a temporal position on a time axis, at which a key is depressed, that is, at what number of beat the key is depressed, or a musical motif expressed by plural depressed keys (sustention, conjunction, capriole). In other words, there are a case where Current Melody tone CM is set to a key other than the currently depressed key and/or a case where Previous Melody tone PM is set to a key other than the previously depressed key. In the chord name determining process, Current Melody tone CM and Previous Melody tone PM are mainly decided at steps 504 to 510, and Current Chord name CurCH is specifically decided based on Current Melody tone CM, Previous Melody tone PM and Previous Chord name PreCH at step 511.

CPU 21 specifies beat information, to which the current time belongs and depressed-key information (a timing of "key-on" and a time duration to "key-off"), and specifies a key which is depressed at the current beat and obtains at step 501 information of a key that is depressed in a duration (previous beat duration) immediately prior to the beat to which the current time belongs. At step 501, the information of a key which is depressed at the current beat will be used as an initial value of Current Melody tone CM and information of a key that is depressed at the leading position of the previous beat duration will be used as an initial value of Previous Melody tone PM.

CPU 21 judges at step 502 whether or not there exists any key being depressed at the leading position of a beat duration to which the current time belongs. When it is determined NO at step 502, the chord name determining process finishes. When it is determined YES at step 502, CPU 21 copies Current Chord name CurCH to Previous Chord name PreCH at step 503.

CPU 21 sets table designating information for designating a chord table to information for designating a second chord table at step 504. The chord table will be described later. The chord table contains a first chord table and second chord table, wherein the first chord table is mainly used when a key is depressed at the first beat and the second chord table is used in the other case. The first chord table and the second chord table are stored in ROM 22. The table designating information is used to designate which chord table is to be used, the first or the second chord table, and said information is stored in RAM 23.

CPU 21 judges at steps 505 to 508 at which temporal position on the time axis a key has been depressed, that is, at what number of beat the key has been depressed. When it is decided at step 505 that the key has been depressed at the first beat (YES at step 505), or when it is decided at step 506 that the key has been depressed at the third beat (YES at step 506), CPU 21 performs a note deciding process corresponding to the first and third beat (first and third-beat note deciding process) at step 507. When it is decided at step 508 that the key has been depressed at the second beat (YES at step 508), CPU 21 performs the note deciding process corresponding to the second beat (second-beat note deciding process) at step 509. When it is decided NO at step 508, that is, when it is decided that the key has been depressed at the fourth beat, CPU 21 performs the note deciding process corresponding to the fourth beat (fourth-beat note deciding process) at step 510.

In the present embodiment, the musical piece is a tour-four time, and one measure contains four beats. When a key is depressed at n-th beat, this means that the timing of key-depressing falls between the leading position of the n-th beat and the leading position of the (n+1)-th beat on the time axis, in other words, the timing of key-depressing comes after the leading position of the n-th beat and prior to the leading position of the (n+1)-th beat on the time axis.

A musical piece has a concept of composing elements such as time or meter in music and beats. In the concept of time, every beat has emphasis, and a melody advances in consideration emphasis of beats. In a syncopated music, emphasis of beats can transit. In the present embodiment, tones which compose the most appropriate melody flow are extracted in consideration of beat emphasis, and Current Melody tones CM and Previous Melody tones PM, which are appropriate for chord determination are specified.

Figure 6:
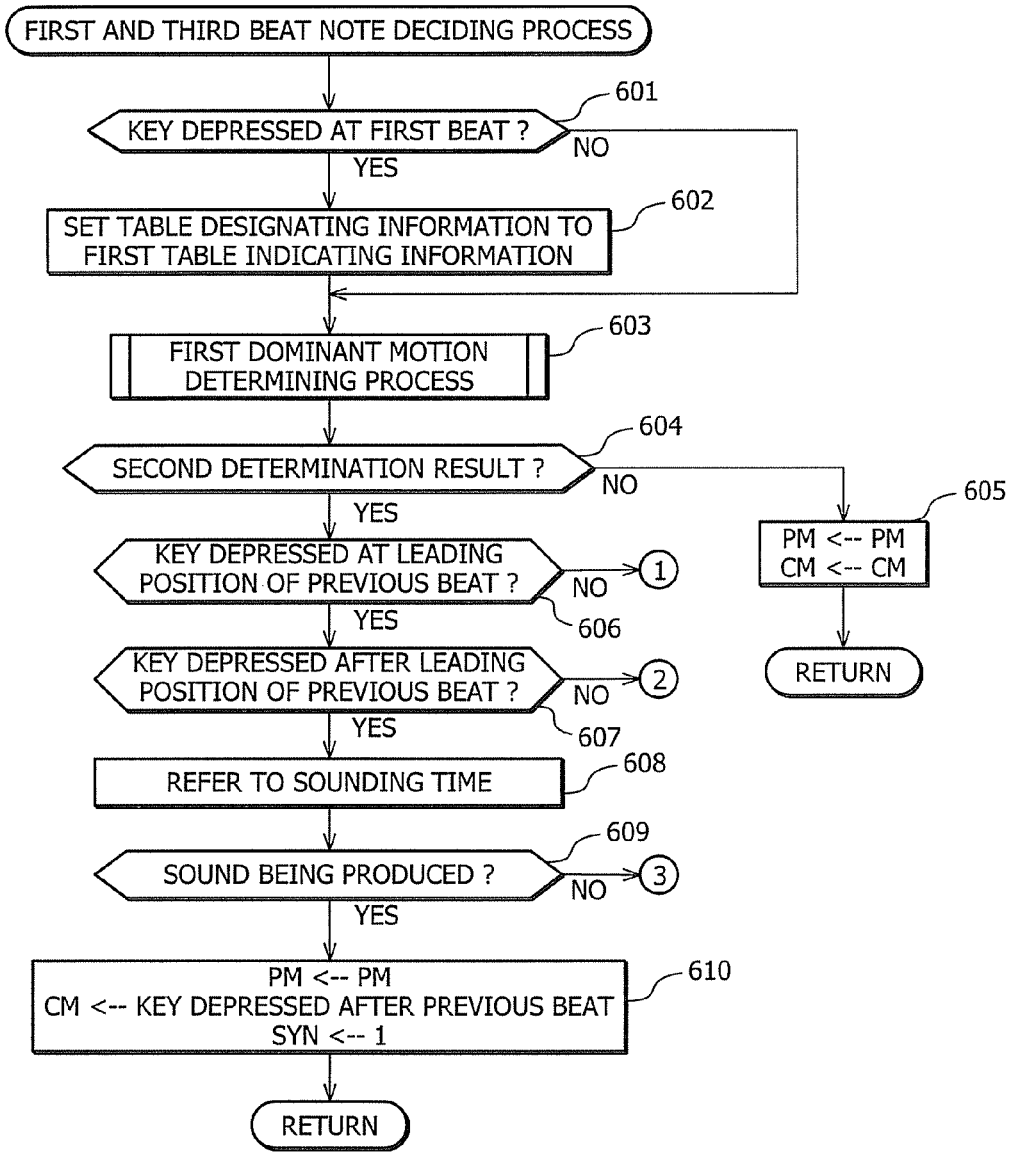
FIG. 6 is a flow chart of an example of a note deciding process corresponding to the first and third beat in the present embodiment.

FIGS. 6-9 are flow charts of an example of the first and third-beat note deciding process in the present embodiment. In FIG. 6, CPU 21 judges at step 601 whether or not a key has been depressed at the first beat. When it is determined at step 601 that a key has been depressed at the first beat (YES at step 601), CPU 21 changes the table designating information to information indicating the first table at step 602. Then, CPU 21 performs a dominant motion determining process at step 603.

Figure 10:
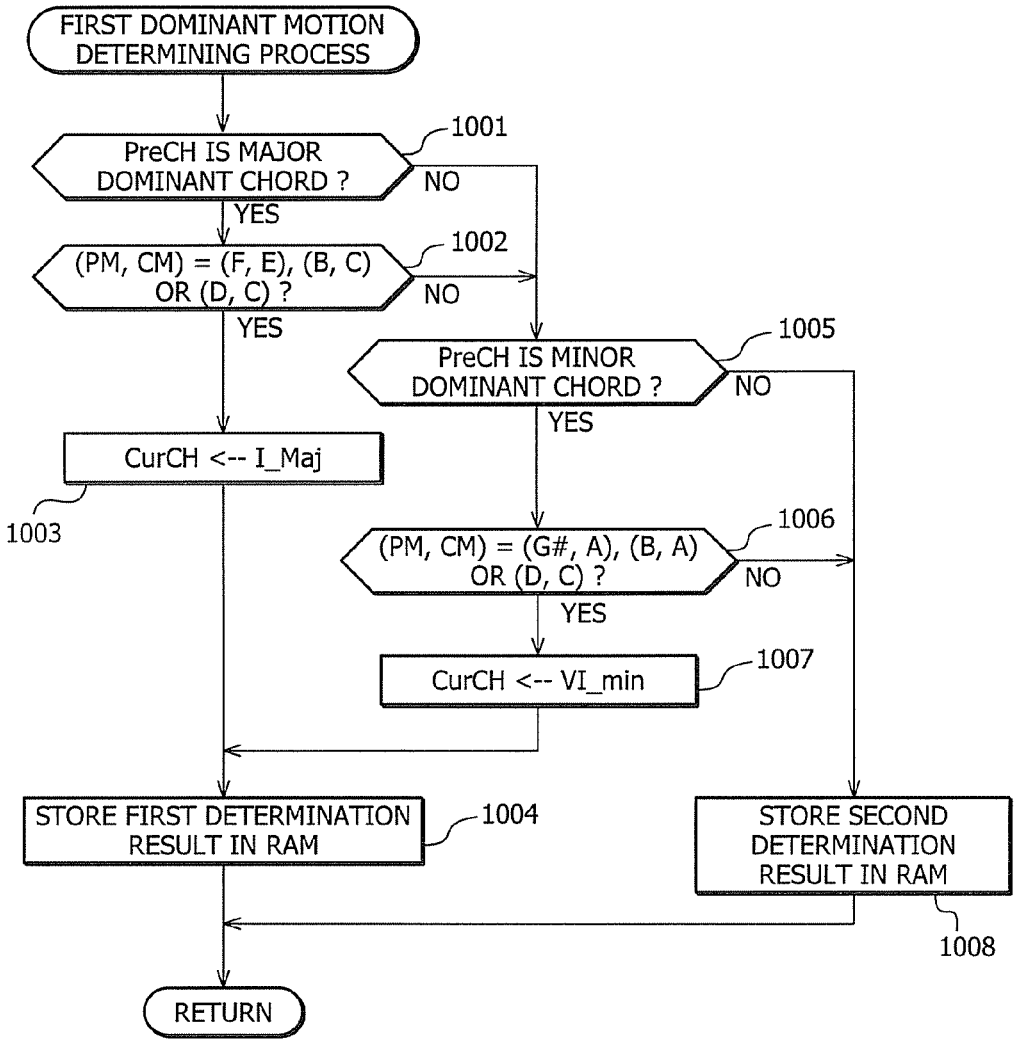
FIG. 10 is a flow chart of an example of a first dominant motion determining process in the present embodiment.

The dominant motion determining process is to extract a dominant motion (that is, advance from dominant to tonic) from the melody flow. In the present embodiment, a first dominant motion determining process and a second dominant motion determining process are used, wherein the first dominant motion determining process is performed in consideration of a chord name in the process and the second dominant motion determining process is performed without consideration of a chord name in the process. FIG. 10 is a flow chart of the first dominant motion determining process in the present embodiment.

In FIG. 10, CPU 21 judges at step 1001 whether or not Previous Chord name PreCH stored in RAM 23 corresponds to any of major dominant chords. In the first dominant motion determining process in the present embodiment, the major dominant chords are "VMaj", "V7", and "VIIm7 (−5)". When it is determined at step 1001 that Previous Chord name PreCH corresponds to one of major dominant chords (YES at step 1001), CPU 21 judges at step 1002 whether (PM, CM) is equivalent to any of (F, E), (B, C) and (B, C), wherein (PM, CM) is a set of a value of Previous Melody tone PM and a value of Current Melody tone CM. It is judged at step 1002 whether or not transition from Previous Melody tone PM to Current Melody tone CM is equivalent to transition to resolve from the dominant to the tonic in a major chord progression.

When it is determined YES at step 1002, CPU 21 determines to set the Current Chord name CurCH to "Imaj", and stores the concerned information in RAM 23 at step 1003. Then, CPU 21 stores in RAM 23 information indicating that the first determination result has been obtained in the dominant motion process (step 1004). When it is determined NO at step 1001, or when it is determined NO at step 1002, CPU 21 judges at step 1005 whether or not Previous Chord name PreCH corresponds to any of minor dominant chords. In the present embodiment, for instance, the minor dominant chords are "IIIMaj" and "III7".

When it is determined YES at step 1005, CPU 21 judges at step 1006 whether (PM, CM) is equivalent to any of (G#, A), (B, A) and (D, C). It is judged at step 1006 whether or not transition from Previous Melody tone PM to Current Melody tone CM is equivalent to transition to resolve from the dominant to the tonic in a minor chord progression. When it is determined YES at step 1006, CPU 21 determines to set Current Chord name CurCH to "VImin", and stores the concerned information in RAM 23 at step 1007. Then, CPU 21 advances to step 1004.

When it is determined NO at step 1005 or when it is determined NO at step 1006, CPU 21 stores in RAM 23 information indicating that the second determination result has been obtained in the dominant motion process (step 1008).

When the first dominant motion recognition process has finished at step 603 in FIG. 6, CPU 21 judges at step 604 whether or not the result of the first dominant motion determining process is a second determination result. When it is determined NO at step 604, that is, when the result of the first dominant motion determining process is a first determination result, CPU 21 stores Previous Melody tone PM and Current Melody tone CM in RAM 23 without modification from their initial values respectively (step 605), and finishes the process. When it is determined YES at step 604, CPU 21 refers to the depressed-key information stored in RAM 23, judging whether or not a key has been depressed at a beat just before the beat corresponding to the current time (step 606).

When it is determined YES at step 606, CPU 21 refers to the depressed-key information stored in RAM 23, judging whether or not a key has been depressed after the leading position of the just previous beat (step 607). When it is determined NO at step 607, this means that keys of a quarter note have been depressed at the just previous beat and at the current beat, respectively. The process in this case will be described later. When it is determined YES at step 607, CPU 21 refers to the depressed-key information stored in RAM 23, or more particularly, refers to a sounding time of a key which is depressed after the leading position of the just previous beat, indicated in the depressed-key information, and judges whether or not a sound(s) is being produced at present at step 609. It is judged at step 609, whether or not a depressed key corresponds to syncopation, when the key is depressed after the leading position of just previous beat and kept depressed even if the key has not been depressed at the leading position of a beat.

When it is determined YES at step 609, CPU 21 stores in RAM 23 Previous Melody tone PM with its initial value, and meanwhile sets a key which is depressed after the leading position of just previous beat to Current Melody tone CM and sets a syncopation flag SYN to "1", storing these CM and SYN in RAM 23 at step 610. Previous Melody tone PM and Current Melody tone CM are stored in RAM 23. Since the depressed key corresponding to syncopation has a similar weighting to a key depressed at the leading position of a beat, the former will be treated in an equivalent manner to the latter.

Figure 7:
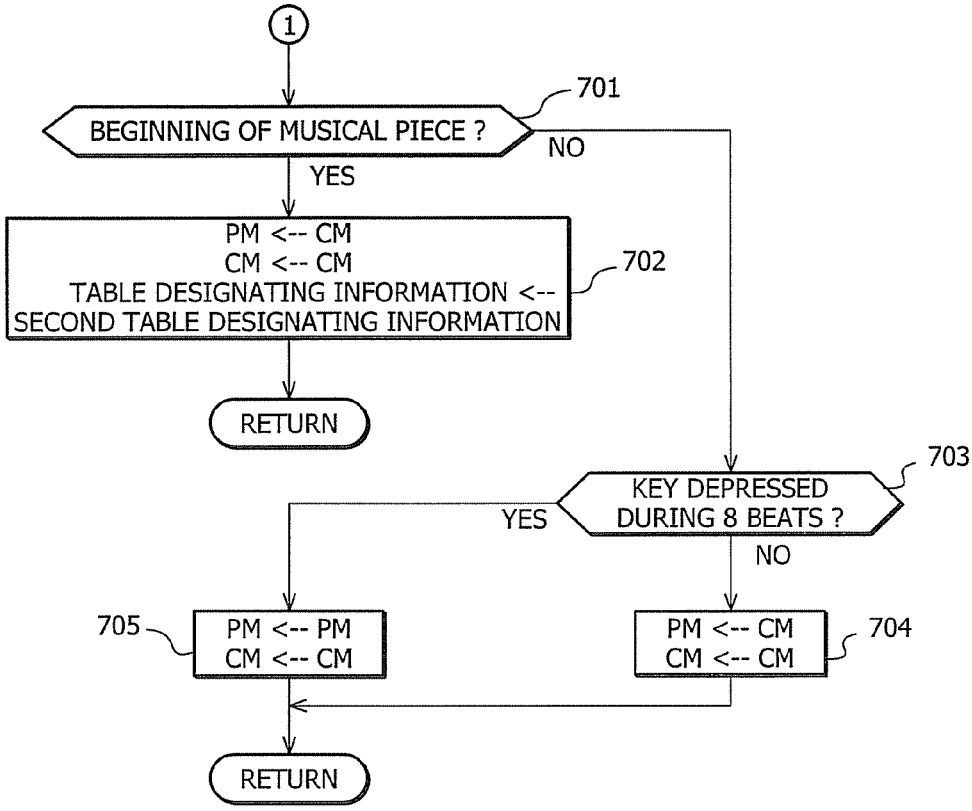
FIG. 7 is a flow chart of an example of the note deciding process corresponding to the first and third beat in the present embodiment.

An operation to be performed when it is determined NO at step 606 will be described with reference to a flowchart of FIG. 7. When it is determined NO at step 606, CPU 21 judges at step 701 whether or not the present key depressing operation at the leading position of a beat corresponds to a beginning of a musical piece. The judgment of step 701 is made by referring to the depressed-key information to judge if the present key depressing operation corresponds to the first depressed-key information. When it is determined YES at step 701, Current Melody tone CM is set to Previous Melody tone PM. Further, Current Melody tone CM is not changed from the initial value, but CPU 21 changes the table designating information to information of designating the second chord table at step 702.

When it is determined NO at step 701, CPU 21 judges at step 703 whether or not a key has not been depressed during a period of 8 beats or more. When it is determined at step 703 that a key has not been depressed (NO at step 703), CPU 21 holds Current Melody tone CM at the initial value and sets Previous Melody tone PM to Current Melody tone CM, and stores the information in RAM 23 at step 704. In the case that it is determined NO at step 703, no key has been depressed over more than 2 measures. In this case, since weighting of the melody sequence is ceased, the initial value of Previous Melody tone PM of a key that is depressed before 2 measures or more is ignored. Meanwhile, when it is determined at step 703 that a key has been depressed during a period of 8 beats (YES at step 703), CPU 21 holds Previous Melody tone PM and Current Melody tone CM at their initial values at step 705.

An operation to be performed when it is determined NO at step 607 will be described with reference to a flow chart of FIG. 8. That is, when it is determined at step 607 that a key has not been depressed after the leading position of the just previous beat (NO at step 607), CPU 21 judges at step 801 whether or not Current Melody Function CMF is Other Tone OT, wherein Current Melody Function CMF is a function of Current Melody tone CM with respect to Previous Chord mane PreCH. In the present embodiment, Current Melody Function CMF is either of Chord Tone CT, Scale Note SN and Other Tone OT, wherein Chord Tone CT indicates that Current Melody tone CM is a chord composing tone of Previous Chord name PreCH and Scale Note SN indicates that Current Melody tone CM is a composing tone of the current scale (tonality) and Other Tone OT indicates that Current Melody tone CM is other tone.

More specifically, a melody function table, in which the chord names are associated with tone names respectively is stored in ROM 22, and CPU 21 refers to a value corresponding to a set of Current Melody tone CM and Previous Chord name PreCH, judging Current Melody Function. FIG. 25 is a view showing an example of the melody function table in the present embodiment. In the melody function table 2500 shown in FIG. 25 can be obtain a certain value corresponding to a set of Current Melody tone CM and Previous Chord name PreCH. In the melody function table 2500 shown in FIG. 25, CT denotes Chord tones (for instance, reference numerals: 2501 to 2603), SN denotes Scale Notes (for instance, reference numerals: 2511 to 2513), and blank spaces (for instance, reference numerals: 2521, and 2522) mean Other Tone OT.

Figure 8:
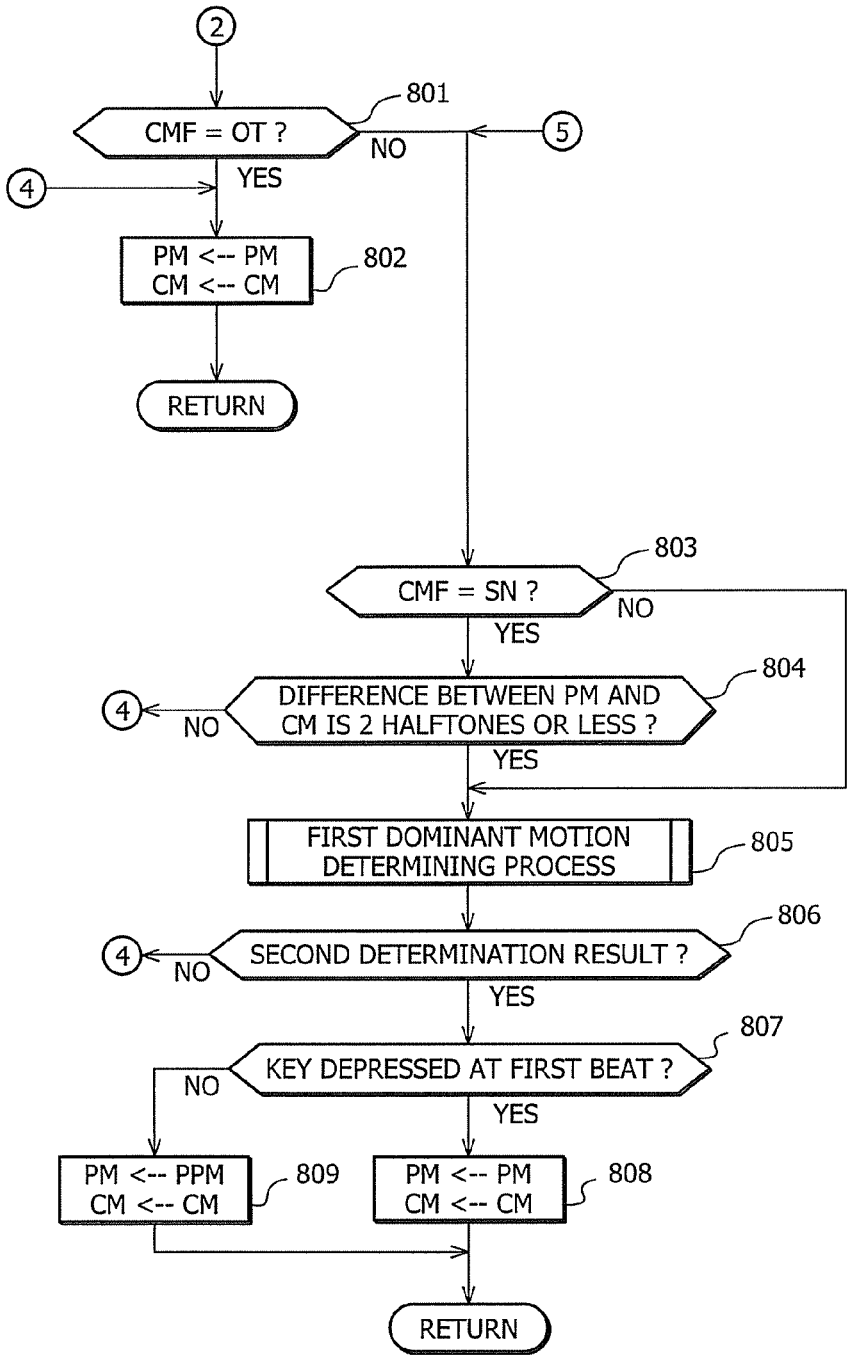
FIG. 8 is a flow chart of an example of the note deciding process corresponding to the first and third beat in the present embodiment.
Figure 9:
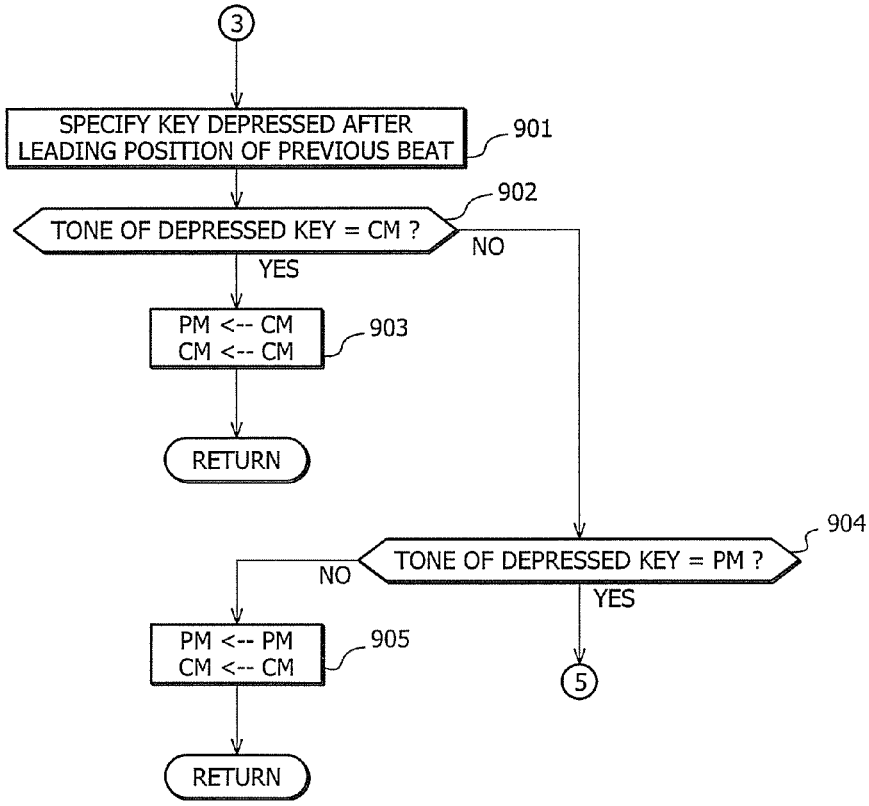
FIG. 9 is a flow chart of an example of the note deciding process corresponding to the first and third beat in the present embodiment.

When it is determined at step 801 in FIG. 8 that Current Melody Function CMF is Other Tone OT (YES at step 801), CPU 21 holds Previous Melody tone PM and Current Melody tone CM at their initial values, respectively at step 802. When it is determined NO at step 801, CPU 21 judges at step 803 whether or not Current Melody Function CMF is Scale Note SN. When it is determined at step 803 that Current Melody Function CMF is Scale Note SN (YES at step 803), CPU 21 judges at step 804 whether or not a difference between Previous Melody tone PM and Current Melody tone CM is 2 halftones or less. In other words, it is judges at step 804 whether or not the sequence of tone is a so-called "conjunct progression". When it is determined YES at step 804, or when it is determined NO at step 803, CPU 21 performs the first dominant motion determining process at step 805.

In the first dominant motion determining process at step 805, CPU 21 judges at step 806 whether or not the result of the first dominant motion determining process is a second determination result. When it is determined NO at step 806, that is, when it is determined that the result of the first dominant motion determining process is the first determination result, CPU 21 holds Previous Melody tone PM and Current Melody tone CM at their initial values at step 802. When it is determined YES at step 806, CPU 21 judges at step 807 whether or not a key has been depressed at the first beat. When it is determined YES at step 807, CPU 21 holds Previous Melody tone PM and Current Melody tone CM at their initial values at step 808.

Meanwhile, when it is determined NO at step 807, that is, when a key to be processed corresponds to the third beat, CPU 21 gives Previous Melody tone PM a pitch PPM of a key, which has been depressed prior to the initial Previous Melody tone PM (step 809). Current Melody tone CM is held at the initial value. This is because there is a strong possibility that a musical tone composing conjunct progression at the third beat can be an ornamental tone and it is considered appropriate that a tone greatly effecting the melody line will be a musical tone at the just previous beat.

Now, operation will be described, which will be performed when it is determined at step 609 that the depressed key does not correspond to syncopation (NO at step 609). At step 901 in FIG. 9, CPU 21 specifies a tone of a key depressed after the leading position of the just previous beat. CPU 21 judges at step 902 whether or not a pitch of the specified depressed-key tone is the same as the initial Current Melody tone CM. When it is determined YES at step 902, CPU 21 holds Current Melody tone CM at the initial value and meanwhile gives Current Melody tone CM to Previous Melody tone PM at step 903. For instance, when a melody progresses in the order of eight notes "D", "C" in the just previous beat, and a key of "C" is depressed at the current beat, the first tone of "D" in the just previous beat is considered to be an ornament tone, and a sequence from "D" to "C" is considered not proper but a sequence from "C" to "C" is considered proper. Therefore, Previous Melody tone PM is set to the same as Current Melody tone CM and the same tones are continued.

When it is determined NO at step 902, CPU 21 judges at step 904 whether or not all the tones of keys depressed after the leading position of the specified beat are equivalent to Previous Melody tone PM. When it is determined YES at step 904, CPU 21 advances to step 803. For instance, it is considered that four keys of sixteenth notes "D", "C", "C" and "C" have been depressed in the just previous beat. In this case, it can be considered that even if the note "D" is at the leading position of the beat, said note "D" can be an ornament tone. Therefore, there is a case that Previous Melody tone PM should not be set to the key of "D" depressed at the leading position. Then, the processes at step 803 and the following steps are performed.

Meanwhile, when it is determined NO at step 904, CPU 21 holds Previous Melody tone PM and Current Melody tone CM at their initial values at step 905.

Now, the second-beat note deciding process (step 509 in FIG. 5) will be described. FIGS. 11 to 14 are flow charts of examples of the second-beat note deciding process in the present embodiment. At step 1101 in FIG. 11, CPU 21 judges whether a key has been depressed at the first beat. When it is determined at step 1101 that a key has not been depressed at the first beat, CPU 21 changes the table designating information to information for designating the first chord table at step 1102. For instance, a tone in the previous measure lasts loner and a rest is given at the first beat, and when a phrase starts from the second beat, it is considered in the present embodiment that a tone of a key depressed at the second beat has similar weighting to the first beat, and the first chord table for the chord table for the first beat is used.

In the second-beat note deciding process, the first dominant motion determining process (step 603) in the first and third-beat note deciding process and the processes (steps 604 and 605) performed depending on the determination result are omitted. The processes at steps 1103 to 1107 in the second-beat note deciding process are performed in a similar manner to the processes at steps 606 to 610 in FIG. 6.

Figure 11:
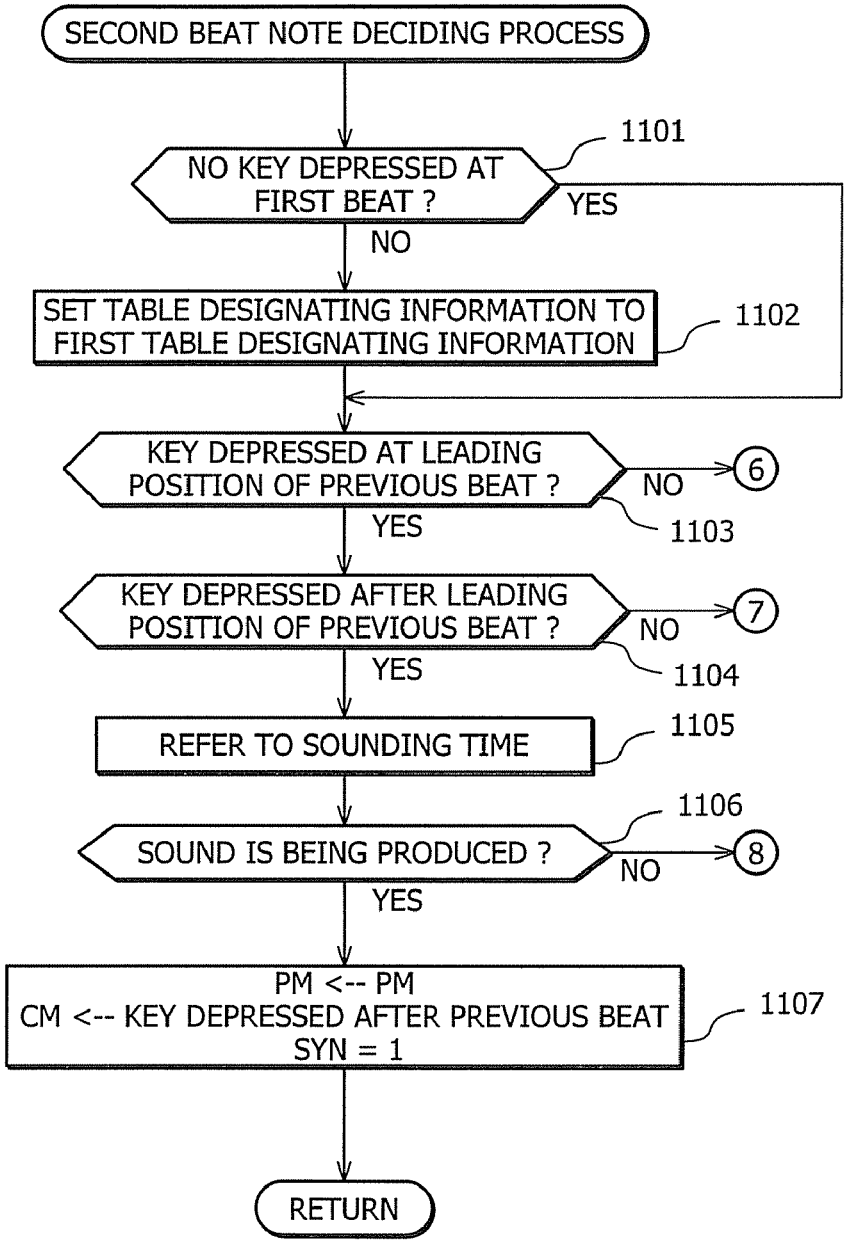
FIG. 11 is a flow chart of an example of a note deciding process corresponding to the second beat in the present embodiment.
Figure 12:
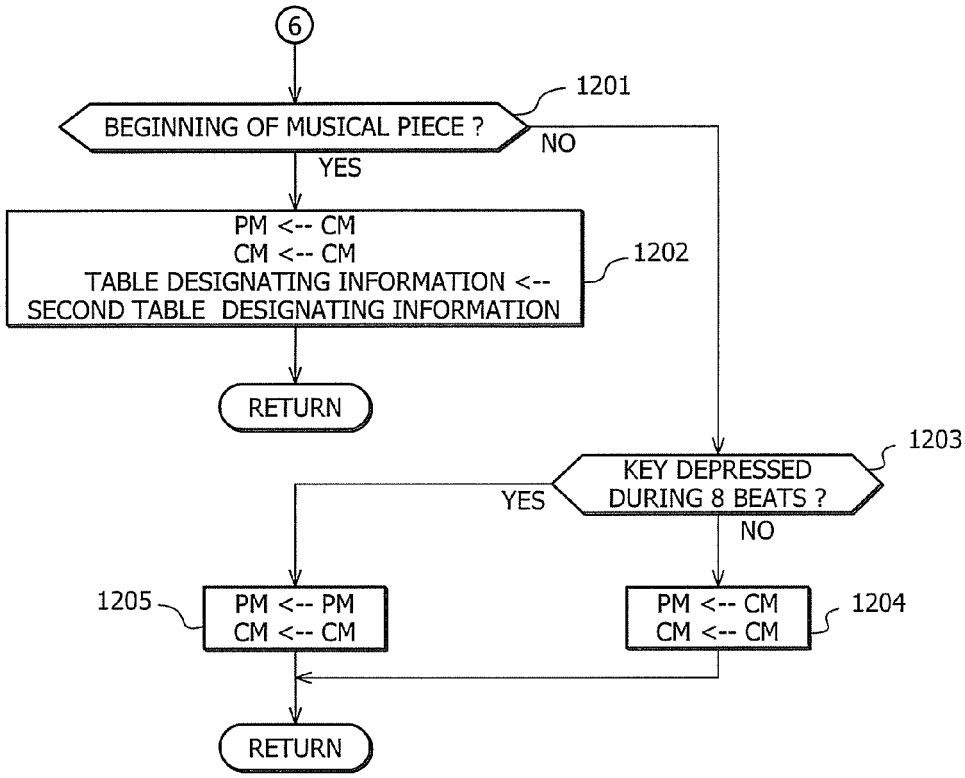
FIG. 12 is a flow chart of an example of the note deciding process corresponding to the second beat in the present embodiment.
Figure 13:
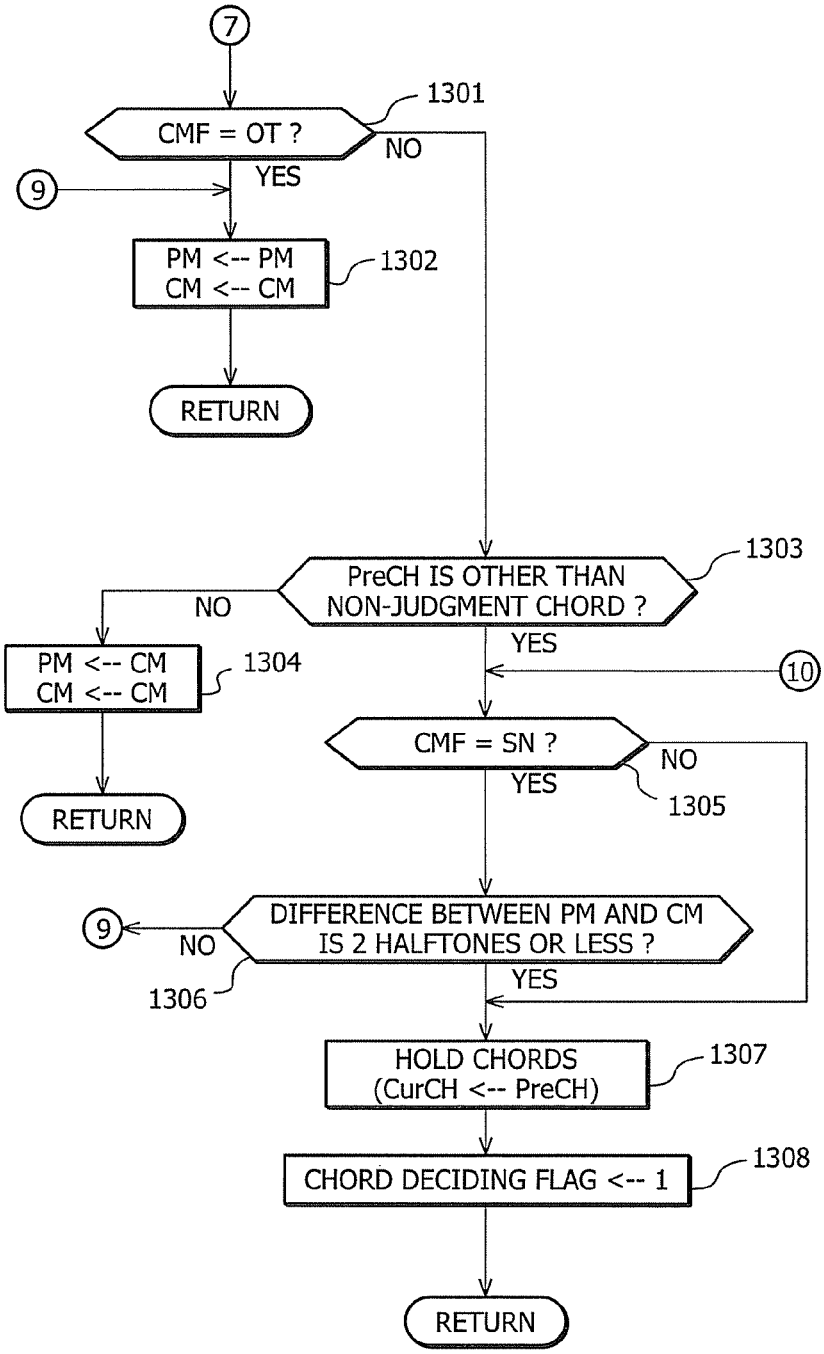
FIG. 13 is a flow chart of an example of the note deciding process corresponding to the second beat in the present embodiment.

FIG. 12 is a flow chart of a process to be performed when it is determined NO at step 1103 in FIG. 11. Processes at steps 1201, 1203 to 1205 are performed in a similar way to the processes at 701, 703 to 705 in FIG. 7. A process at step 1202 is performed in a similar manner to the process at 702 in FIG. 7, excepting that the table information is not changed.

An operation to be performed, when it is determined NO at step 1104, will be described. At step 1301 in FIG. 13, CPU 21 judges whether or not Current Melody tone CM is Other Tone OT. When it is determined YES at step 1301, CPU 21 advances to step 1302. A process at step 1302 is performed in a similar manner to the processes at 801 and 802 in FIG. 8.

Figure 21:
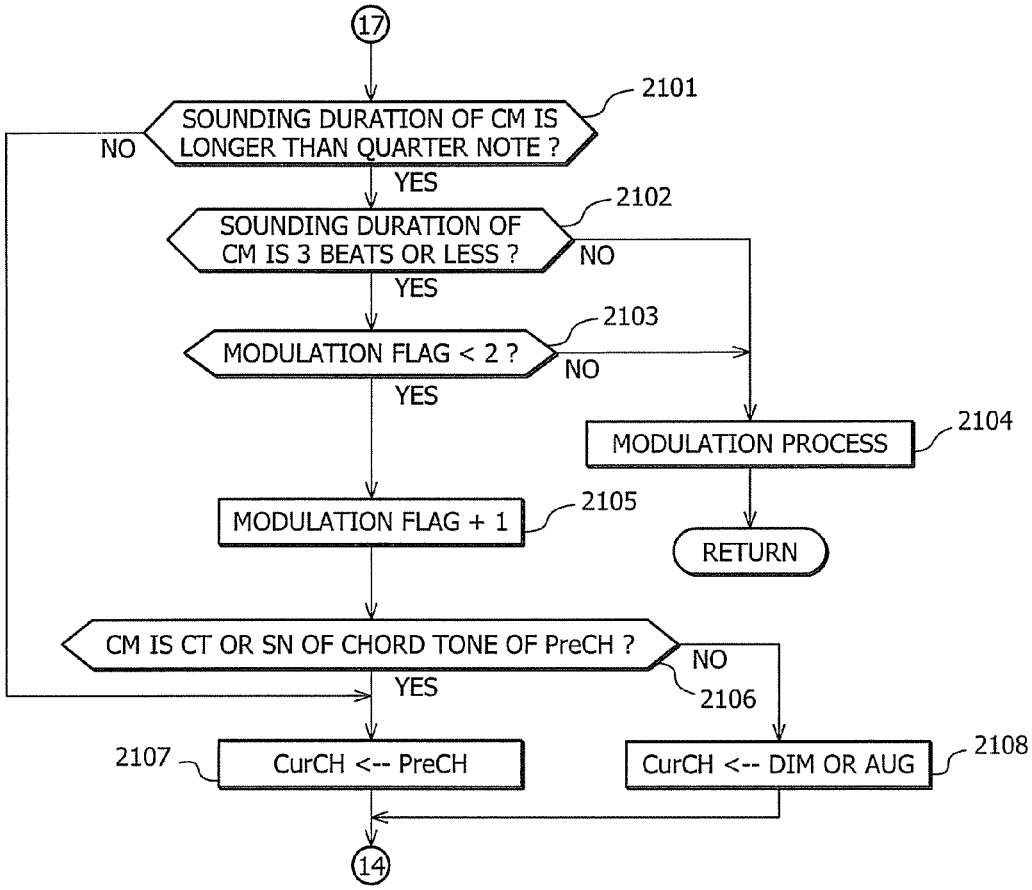
FIG. 21 is a flow chart of an example of the chord deciding process in the present embodiment.

When it is determined NO at step 1301, CPU 21 judges at step 1303 whether or not Previous Chord name PreCH is a chord other than a non-determination chord. As will be described with reference to a process at step 2105 in FIG. 21, a modulation flag of the non-determination chord has been set to "1" or more in the previous process. Therefore, CPU 21 judges at step 1303 if the modulation flag stored in RAM 23 has been set to "1" or more.

When it is determined NO at step 1303, that is, when Previous Chord name PreCH is the non-determination chord, CPU 21 gives Current Melody tone CM to Previous Melody tone PM at step 1304. Meanwhile, when it is determined YES at step 1303, that is, when Previous Chord name PreCH is a chord other than the non-determination chord, CPU 21 judges at step 1305 whether or not Current Melody function CMF is Scale Note SN. When it is determined at step 1303 that Current Melody Function CMF is Scale Note SN (YES at step 803), CPU 21 judges at step 1306 whether or not a difference between Previous Melody tone PM and Current Melody tone CM is 2 halftones or less. Processes at steps 1305 and 1306 are performed in a similar manner to the processes at steps 803 and 804 in FIG. 8. When it is determined NO at step 1305, or when it is determined YES at step 1306, CPU 21 sets Current Chord name CurCH to Previous Chord name PreCH at step 1307. In other words, Previous Chord name PreCH is held.

With respect to the second beat and the fourth beat, since a chord holding operation is performed to hold Previous Chord name PreCH, a proper chord holding is realized. In the present embodiment, when Current Melody function CMF is Chord Note CT, or when Current Melody function CMF is Scale Note SN and the sequence of tones is the conjunct progression, the chord holding operation is being performed. In a musical piece of a quadruple rhythm, the second beat and the fourth beat are weak beats or upbeats, and therefore, as far as these weak beats or upbeats are not emphasized in the melody, the chords of the second and fourth beat fundamentally hold the chords of the first and third beat, respectively.

Figure 28:
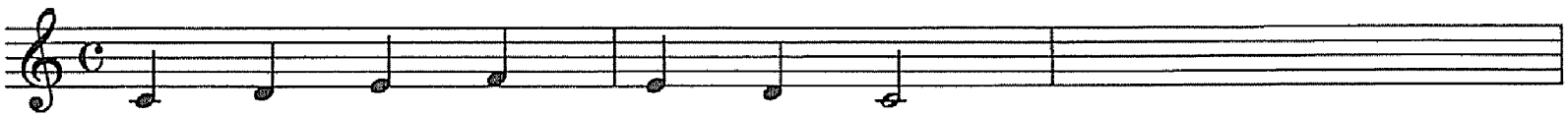
FIG. 28 is a view showing an example of a musical score.

For instance, a musical piece shown in FIG. 28 has tones of "C", "D", "E", "F", "E", "D" and "C" at the leading position of each beat, and the sequence of the tones is the conjunct progression. In practice, an appropriate chord name of the sequence is IMaj (CMaj). But if processes are not performed at steps 1305 to 1307, the second and fourth beat are given chord names other than IMaj(CMaj). Therefore, a chord holding is performed under a certain condition at steps 1305 and 1306, whereby appropriate chord names given to the second and fourth beat.

After step 1307, CPU 21 sets a chord deciding flag to "1" at 1308. This is because a following chord deciding process is not necessary, since Current Chord name CurCH has been decided at step 1307.

When it is determined NO at step 1306, CPU 21 holds Previous Melody tone PM and Current Melody tone CM at their initial values, respectively at step 1302.

Figure 14:
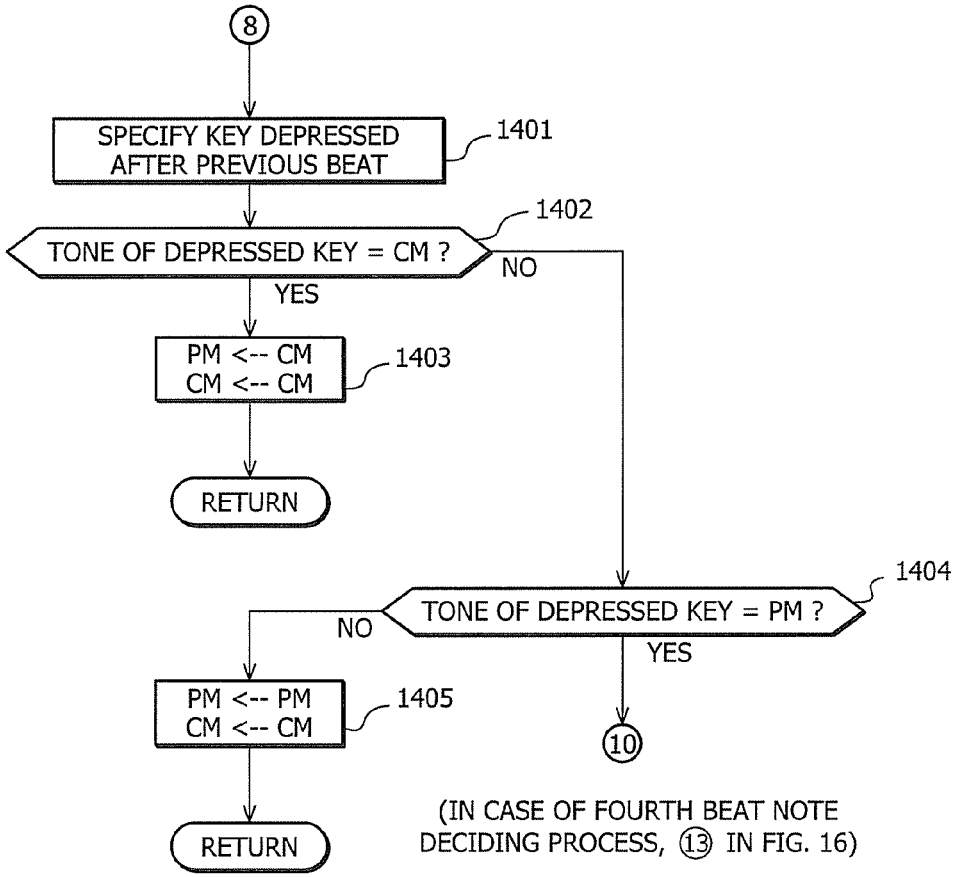
FIG. 14 is a flow chart of an example of the note deciding process corresponding to the second beat in the present embodiment.
Figure 15:
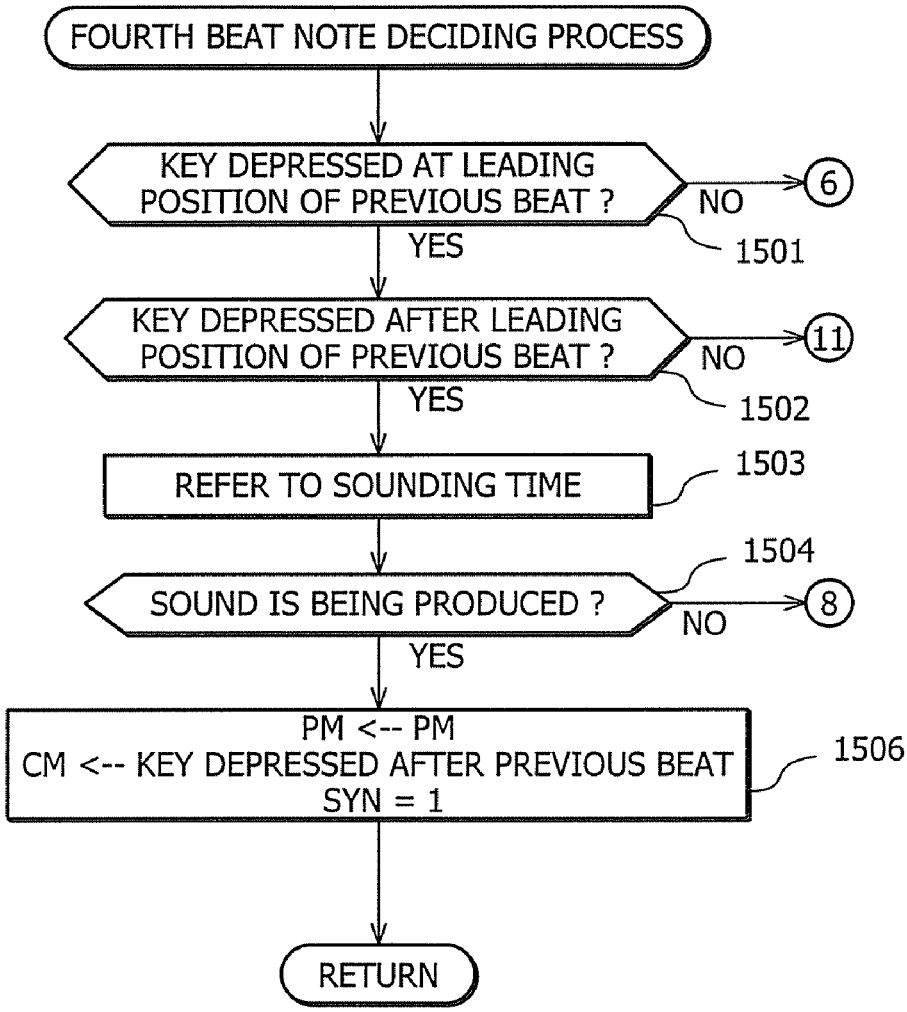
FIG. 15 is a flow chart of an example of a note deciding process corresponding to the fourth beat in the present embodiment.
Figure 16:
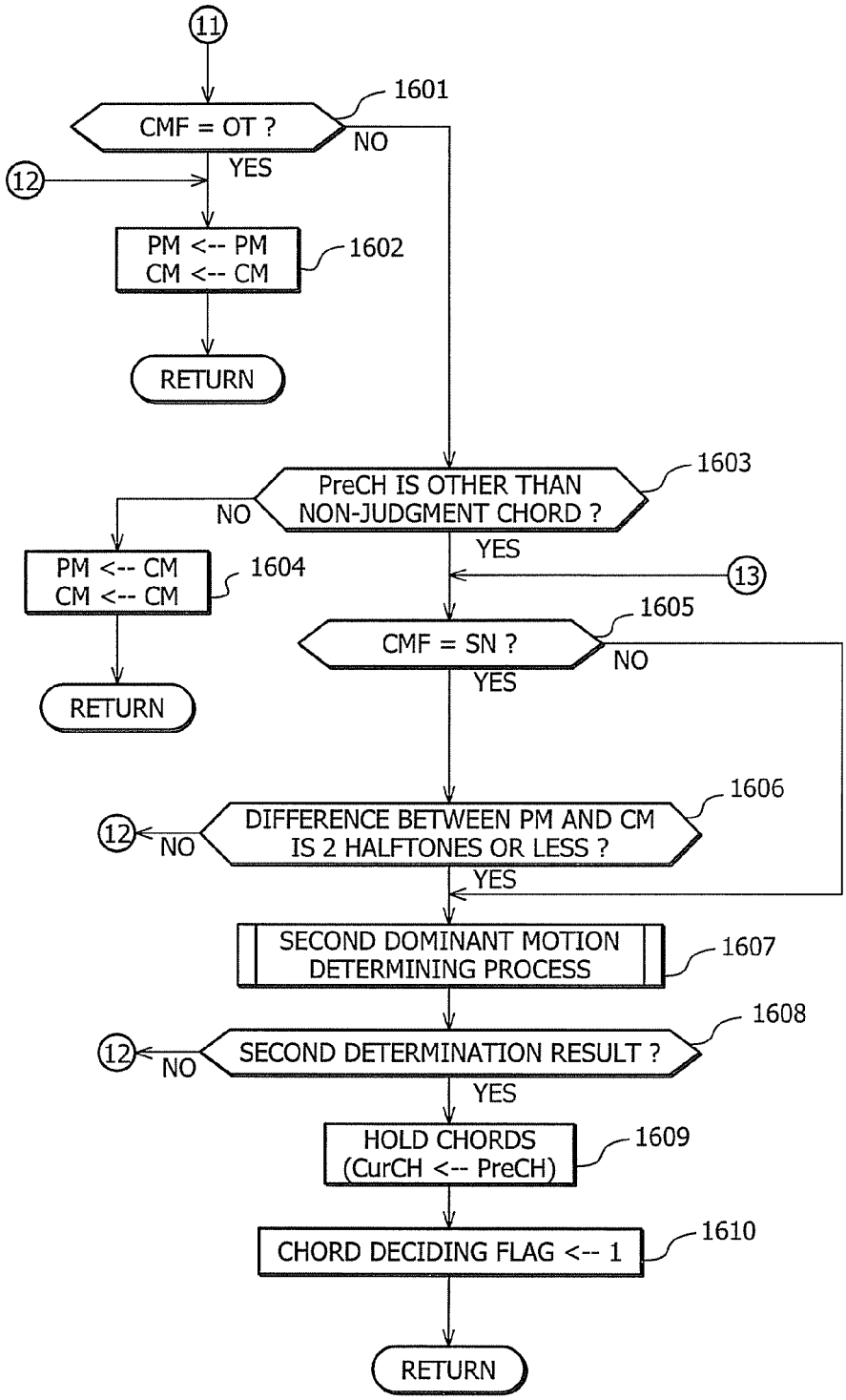
FIG. 16 is a flow chart of an example of the note deciding process corresponding to the fourth beat in the present embodiment.

An operation to be performed when it is determined NO at step 1106 will be shown in FIG. 14. Processes at steps 1401 to 1405 are performed in a similar manner to the processes at steps 901 to 905 in FIG. 9. When it is determined YES at step 1404, CPU 21 advances to step 1305 in FIG. 13, where CPU 21 judges whether the chord holding operation should be performed or not Now, the fourth-beat note deciding process (step 510) will be described. FIGS. 15 and 16 are flow charts of examples of the fourth-beat note deciding process in the present embodiment. The fourth-beat note deciding process is similar to the second-beat note deciding process.

As shown in FIG. 15, the process (step 1101 in FIG. 11) of judging whether or not a key has been depressed at the first beat and the following process (step 1102 in FIG. 11) are omitted from the flow chart of the fourth-beat note deciding process. Processes at steps 1501 to 1505 in FIG. 15 are performed in a similar manner to the processes at steps 1103 to 1107 in FIG. 11. When it is determined YES at step 1501, an operation is performed in accordance with the flow chart of FIG. 12.

When it is determined NO at step 1502, an operation is performed in accordance with the flow chart of FIG. 16. Processes at steps 1601 to 1606 in FIG. 16 are performed in a similar manner to the processes at steps 1301 to 1306 in FIG. 13. In the fourth-beat note deciding process, when it is determined NO at step 1605 or when it is determined YES at step 1606, the second dominant motion determining process (step 1607) is performed, and it is judged based on the result whether the chord holding operation should be performed or not.

Figure 17:
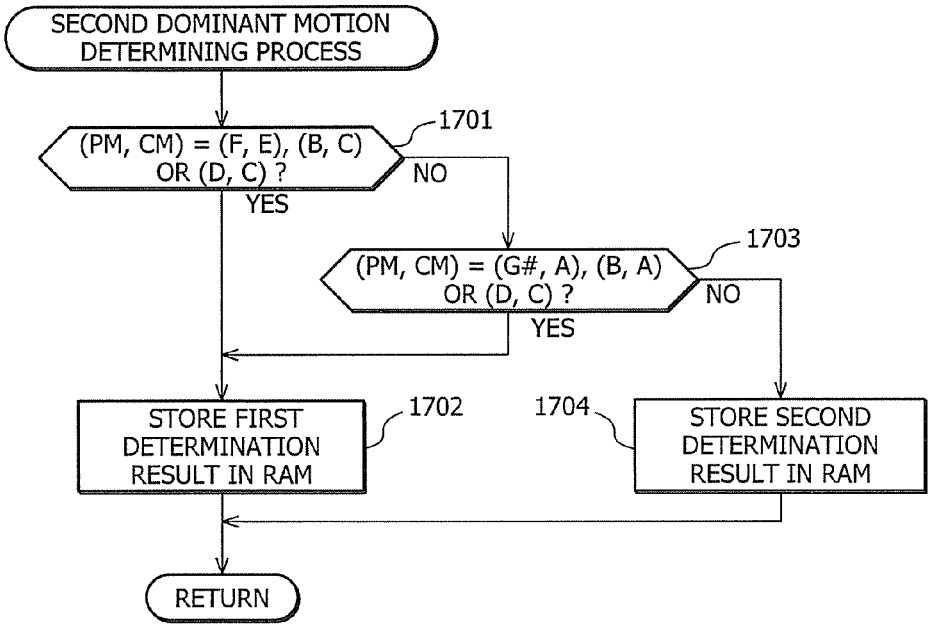
FIG. 17 is a flow chart of an example of a second dominant motion determining process in the present embodiment.

FIG. 17 is a flow chart of an example of the second dominant motion determining process in the present embodiment. In the second dominant motion determining process, only a transition in melody tone is judged but the sort of the chord of Previous Chord name PreCH is not considered. As shown in FIG. 17, CPU 21 judges at step 1701 whether (PM, CM) is equivalent to any of (F, E), (B, C) and (D, C). The judgment at step 1701 is similar to the judgment at step 1002 in FIG. 10. When it is determined NO at step 1701, CPU 21 judges at step 1703 whether (PM, CM) is equivalent to any of (G#, A), (B, A) and (D, C). The judgment at step 1703 is similar to the judgment at step 1006 in FIG. 10.

When it is determined YES at step 1701, or when it is determined YES at step 1703, CPU 21 stores in RAM 23 information indicating that the first determination result has been obtained in the dominant motion process (step 1702). Meanwhile, it is determined NO at step 1703, CPU 21 stores in RAM 23 information indicating that the second determination result has been obtained in the dominant motion process (step 1704).

When the second determination result has been obtained in the second dominant motion determining process (YES at step 1608), CPU 21 gives Previous Chord name PreCH to Current Chord name CurCH at step 1609. In other words, Previous Chord name PreCH is held at step 1609. Then, CPU 21 sets the chord flag in RAM 23 to "1" at step 1610. Meanwhile, when it is determined NO at step 1608, CPU 21 advances to steps 1602 to hold Previous Melody tone PM and Current Melody tone CM at their initial values, respectively.

When it is determined NO at step 1504, an operation will be performed in accordance with the flowchart of FIG. 14.

When the note deciding processes corresponding to respective beats have been performed at steps 507, 509 and 510, the chord deciding process is performed based on Previous Melody tone PM and Current Melody tone CM, modified in the processes (step 511). FIGS. 18 to 21 are flow charts of examples of the chord deciding process in the present embodiment.

Figure 18:
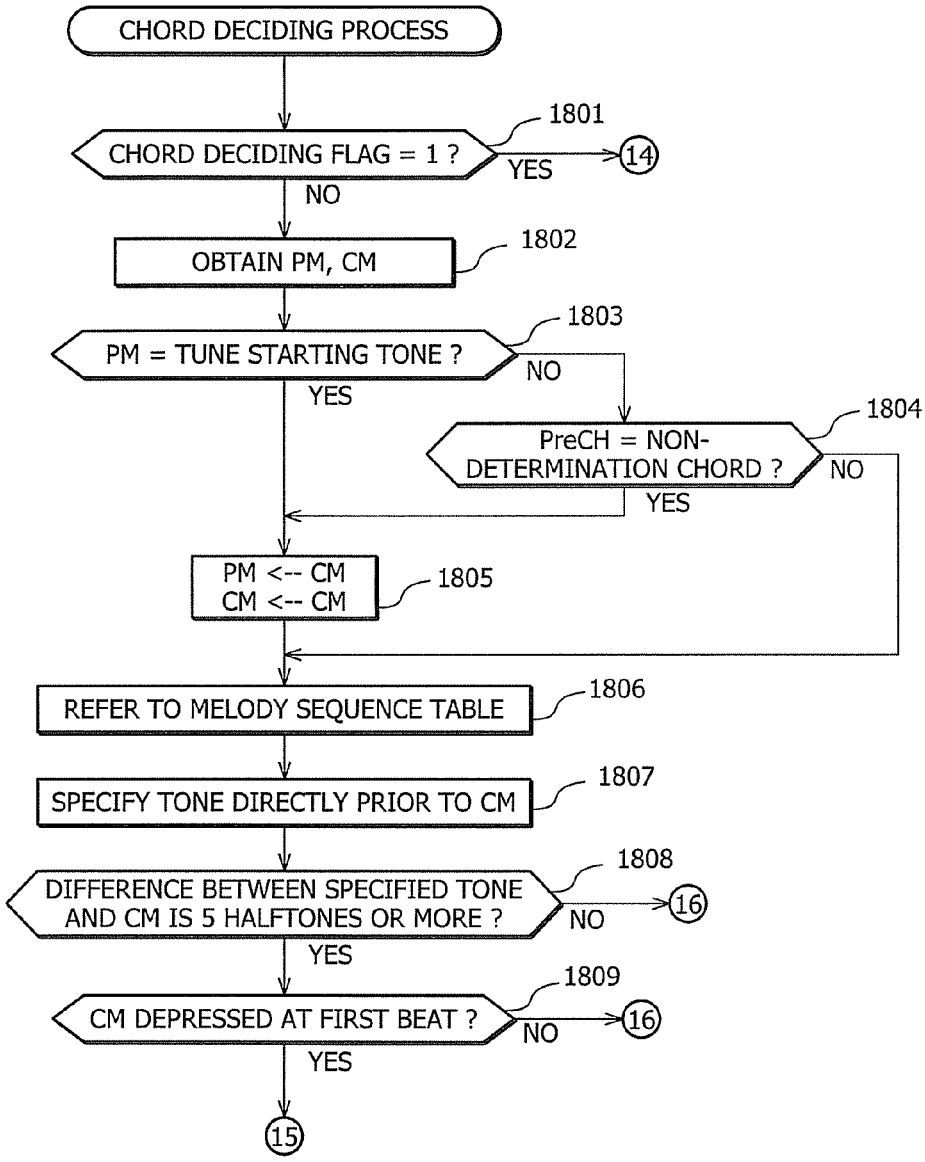
FIG. 18 is a flow chart of an example of a chord deciding process in the present embodiment.
Figure 19:
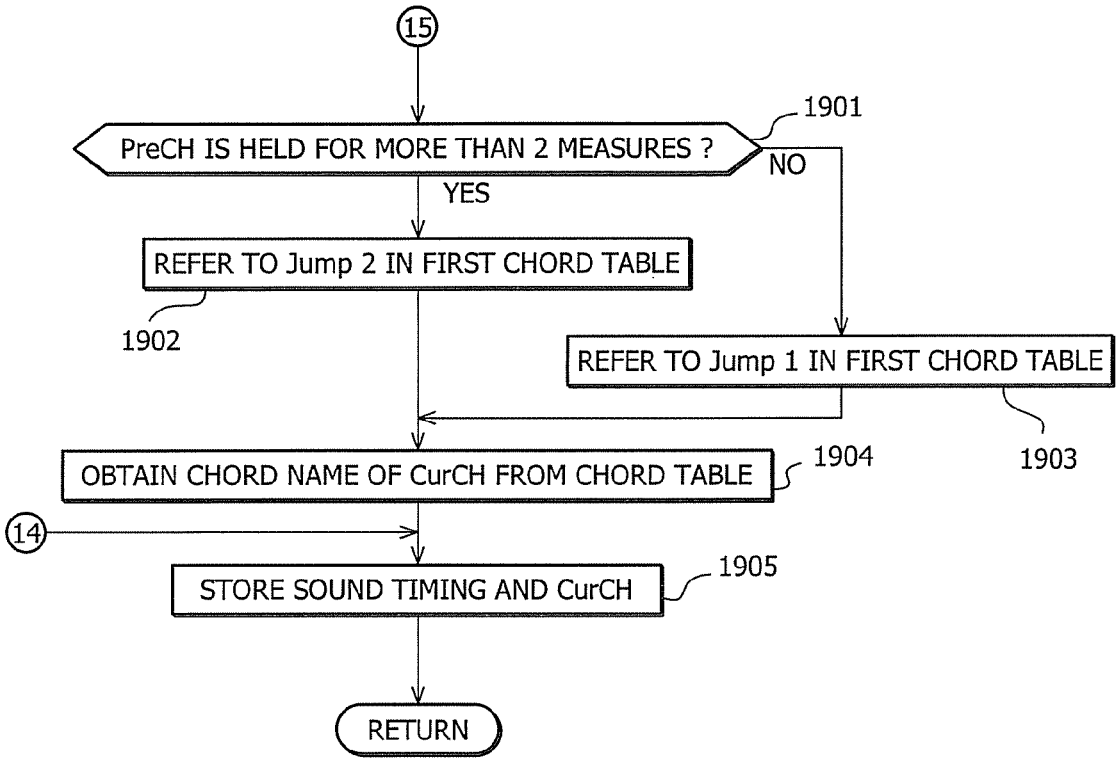
FIG. 19 is a flow chart of an example of the chord deciding process in the present embodiment.

Current Chord name CurCH is decided in the chord holding process, and CPU 21 judges whether or not the chord deciding flag has not been set to "1" (step 1801 in FIG. 18). When it is determined that the chord deciding flag has been set to "1" (step 1801), CPU 21 stores Current Chord name CurCH and its sounding time in a certain area of RAM 23 (step 1905 in FIG. 19).

When it is determined that the chord deciding flag has not been set to "1" (step 1801), CPU 21 reads Previous Melody tone PM and Current Melody tone CM from RAM 23 at step 1802. CPU 21 judges at step 1803 whether or not the Previous Melody tone PM is a tune starting tone. For instance, it is judged at step 1803 whether or not no tone of a depressed key is generated prior to the Previous Melody tone PM. When it is determined NO at step 1803, CPU 21 judges at step 1804 whether or not Previous Chord tone PC is a non-determination chord.

When it is determined YES at step 1803, or when it is determined YES at step 1804, CPU 21 gives Current Melody tone CM to Previous Melody tone PM at step 1805. When it is determined NO at step 1804, CPU 21 starts a new melody sequence, because Previous Chord name PreCH is a non-determination chord.

At step 1806, CPU 21 refers to the melody sequence table, obtaining a set of values corresponding to (PM, CM). FIG. 22 is a view showing an example of the melody sequence table in the present embodiment. As shown in FIG. 22, sets of values corresponding to predetermined sets of Previous Melody tone PM and Current Melody tone CM are stored in the melody sequence table 2200. When a set of values corresponding to (PM, CM) has been found in the melody sequence table 2200, the set of values is temporarily stored in RAM 23. Meanwhile, when a set of values corresponding to (PM, CM) has not been found in the melody sequence table 2200, information indicating that a set of values corresponding to (PM, CM) has not been found in the melody sequence table 2200 is stored in RAM 23.

Then, CPU 21 specifies a tone of a key depressed directly before Current Melody tone CM at step 1807. The tone of the key depressed directly before Current Melody tone CM is a tone of a key just before and cannot be the same as Previous Melody tone PM. CPU 21 compares the tone specified at step 1807 with Current Melody tone CM, judging whether or not a difference in pitch between these tones is 5 halftones or more (step 1808). When it is determined YES at step 1808, CPU 21 judges at step 1809 whether or not Current Melody tone CM relates to a key depressed at the first beat.

Some melody sequence contains a melody tone as a core tone and further contains melody tones before and after the core tone, which ornament the core tone. It is general that the ornamenting melody tones have not much difference in pitch from the core melody tone. Meanwhile, when the ornamenting melody tone has jumped to have the pitch difference (for instance, about 4 degrees) higher than a certain level, in many case a tone following the jumped tone is comparatively much emphasized. Therefore, a pitch difference is judged at step 1808 and thereafter a process is performed depending on the pitch difference.

When it is determined YES at step 1809, CPU 21 judges at step 1901 whether or not Previous Chord name PreCH is held for more than 2 measures. When it is determined YES at step 1901, CPU 21 decides to refer to columns of "jump 2" in the first chord table, and obtains a predetermined chord name from the first chord table (step 1902). Meanwhile, when it is determined NO at step 1901, CPU 21 decides to refer to columns of "jump 1" in the first chord table, and obtains a predetermined chord name from the first chord table (step 1903).

FIG. 23 is a view showing an example of the first chord table in the present embodiment. In FIG. 23, a part of the first chord table is shown. In the first chord table 2300 shown in FIG. 23, a chord name is decided based on Previous Chord Function (Reference numeral: 2310) and a set of (Previous Melody tone PM and Current melody tone CM) (Reference numerals 2301, 2302, etc)

In the present embodiment, three Sorts such as "no jump", "jump 1" and "jump 2" are prepared (Reference numeral 2311). A chord name is decided based on Previous Chord Function, a set of (Previous Melody tone PM and Current Melody tone CM) and the Sort.

Previous Chord Function has three functions such as Tonic "TO", Sub Dominant "SU", and Dominant "DO". Chord names corresponding to Tonic "TO" are "IMaj", "IM7", "IIImin", "IIIm7", "VImin" and "VIm7". Chord names corresponding to Sub Dominant "SU" are "IImin", "IIm7", "IIm7(−5)", "IVMaj", "IVM7", "IVmin" and "IVmM7". Further, chord names corresponding to Dominant "DO" are "IIIMaj", "III7", "III7sus4", "VMaj", "V7", "V7sus4" and "VIIm7" (−5)". Chord names corresponding to each Previous Chord Function are previously stored in RAM 23.

In Sort of "jump 2", a level of change in chord is set large in consideration of jump in the melody sequence and continuation of Previous Chord name. In the meantime, in Sort of "jump 1", a level of change in chord is set lower than in Sort of "jump 2". As will be described later, even if the first chord table 2300 is used, Sort of "no jump" is used in the case where Sort of "jump 1" or "jump 2" is not given.

For instance, in the case where Previous Chord Function of Previous Chord name PreCH is "Tonic", (Previous Melody tone PM, Current Melody tone CM)=(C, G), and Sort is "jump 2", a chord name of "VMaj" (Reference numeral: 2321) is obtained from the first chord table 2300. Further, in the case where Previous Chord Function of Previous Chord name PreCH is "Tonic" "TO", (Previous Melody tone PM, Current Melody tone CM)=(C, G), and Sort is "jump 1", then a chord name of "IMaj" (Reference numeral: 2322) is obtained from the first chord table 2300.

CPU 21 obtains a chord name from the first chord table 2300 for Current Chord name CurCH and stores the obtained chord name in a predetermined area of RAM 23, and also stores a sound timing of the chord name in a predetermined area of RAM 23 (steps 1904, 1905).

Figure 20:
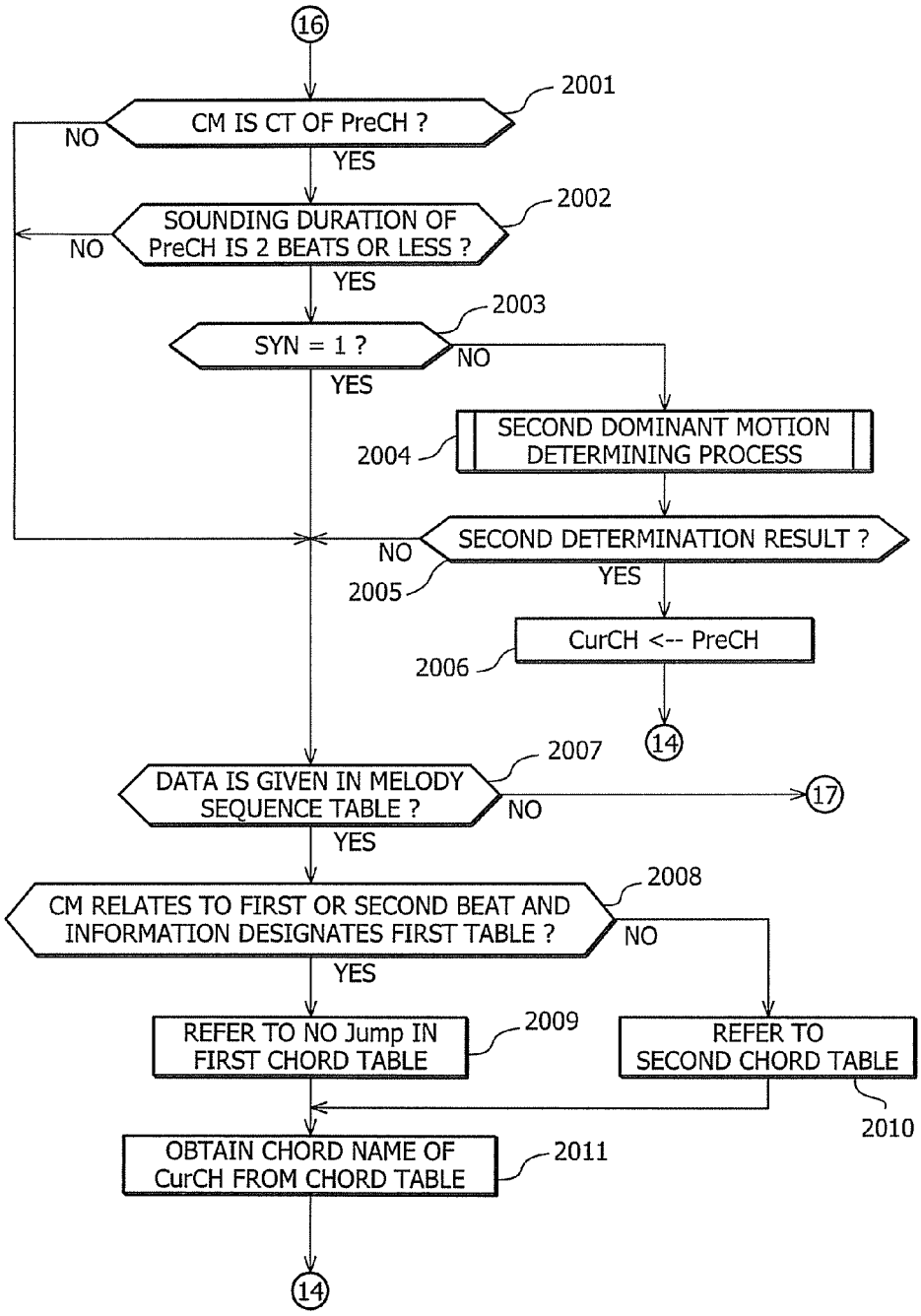
FIG. 20 is a flow chart of an example of the chord deciding process in the present embodiment.

An operation to be performed when it is determined NO at step 1808, or when it is determined NO at step 1809 will be described with reference to a flow chart of FIG. 20. CPU 21 judges at step at step 2001 whether or not Current Melody tone CM is Chord Tone "CT" of Previous Melody tone PreCH. When it is determined YES at step 2001, CPU 21 judges at step 2002 whether or not a sounding duration of Previous Chord name PreCH is equivalent to a period of 2 beats or less, based on the sound timing of the musical tone of Previous Chord name PreCH and the present time. When it is determined YES at step 2002, CPU 21 judges at step 2003 whether or not the syncopation flag has been set to "1".

When it is determined NO at step 2003, CPU 21 performs the second dominant motion determining process, judging if a transition from Previous Melody tone PM to Current Melody tone CM is the dominant motion (step 2005). When the second determination result has been obtained in the second dominant motion determining process (YES at step 2005), CPU 21 sets Previous Chord name PreCH to Current Chord name Cur CH at step 2006. In other words, Previous Chord name PreCH is held.

When it is determined NO at step 2001, at step 2002, or at step 2005, CPU 21 judges at step 2007 whether or not a set of values corresponding to (Previous Melody tone PM, Current. Melody tone CM) has been given in the melody sequence table. Since the set of values or information indicating that the set of values are not given in the sequence table has been stored in RAM 23 at step 1806 in FIG. 18, the judgment at step 2007 is possible by referring to information stored in RAM 23.

When it is determined YES at step 2007, CPU 21 judges at step 2008 whether or not Current Melody tone CM relates to the first beat or second beat and the table designating information indicates the first table. When it is determined YES at step 2008, CPU 21 determines to refer to Sort of "no jump" in the first chord table, obtaining a certain chord name from the first chord table at step 2009. Meanwhile, when it is determined NO at step 2008, CPU 21 determines to refer to the second chord table, obtaining a certain chord name from the second chord table at step 2010.

FIG. 24 is a view showing an example of the second chord table in the present embodiment. In FIG. 24, a part of the second chord table is shown. In the second chord table 2400 shown in FIG. 24, a chord name is decided based on Previous Chord Function (Reference numeral: 2410) and a set of (Previous Melody tone PM and Current melody tone CM) (Reference numerals 2401, 2402, etc). For instance, when Previous Chord Function of Previous Chord name PreCH is Sub Dominant "SU", and (Previous Melody tone PM, Current Melody tone CM)=(C, G), a chord name of "VMaj" (Reference numeral: 2421) is obtained from the second chord table 2400.

CPU 21 obtains a chord name of Current Chord name CurCH from the first chord table 2300 or the second chord table 2400 and stores the specified chord name in a predetermined area of RAM 23, and also stores a sound timing of the chord name in a predetermined area of RAM 23 (steps 2011, 1905).

In the case that it is determined YES at step 2007, an appropriate chord name has been obtained from the chord table, because a set of (Previous Melody tone PM, Current Melody tone CM) is found in the melody sequence table. Meanwhile, when it is determined NO at step 2007, modulation or temporary non-determination chord decision is performed. When it is determined NO at step 2007, CPU 21 judges at step 2101 whether or not a sounding duration of Current Melody tone CM is longer than a quarter note, in other words, whether or not Current Melody tone CM keeps sounding for a period longer than one beat.

When it is determined NO at step 2101, CPU 21 does not change Previous Chord name PreCH and gives Previous Chord name PreCH to Current Chord name CurCH at step 2107. In the case of NO at step 2101, there is a possibility that a player does not consciously depress the correct key but depresses the wrong key. In this case, Previous Chord name PreCH is given to Current Chord name CurCH without any modification made.

When it is determined YES at step 2101, CPU 21 judges at step 2102 whether or not a sounding duration of Current Melody tone CM is equivalent to a period of 3 beats or less. When it is determined YES at step 2102, CPU 21 judges at step 2103 whether or not the modulation flag has been set to "2" or less. When it is determined YES at step 2103, CPU 21 increments the modulation flag stored in RAM 23 at step

2105. When it is determined NO at step 2102, or when it is determined NO at step 2103, CPU 21 performs a modulation process at step 2104.

In the resent embodiment, a melody tone containing Current Melody tone CM and Previous Melody tone PM is fundamentally processed at a scale of "C". Therefore, in the modulation process, a pitch difference between a scale after modulation and the scale of "C" is calculated and the calculated pitch difference is stored in RAM as an offset or discrepancy. After the modulation process, a tone name specified by its key number of a depressed key is decreased by the discrepancy and a process can be performed at the scale of "C".

After incrementing the modulation flag at step 2105, CPU 21 judges at step 2106 whether Current Melody tone CM is Chord Tone "CT" or Scale Note "SN" of Previous Chord name PreCH. At step 2106, CPU 21 refers to the melody function table to judge whether a value corresponding to the set of Current Melody tone CM and Previous Chord name PreCH is Chord Tone "CT" or Scale Note "SN", as in the same manner as in the process at step 801. When it is determined YES at step 2106, CPU 21 gives Previous Chord name PreCH to Current Chord name CurCH to hold the previous chord at step 2107.

When it is determined NO at step 2106, CPU 21 refers to a non-determination chord table, giving a chord of Diminish "dim" or Augment "aug" to Current Chord name CurCH at step 2108. FIG. 26 is a view showing an example of a part of the non-determination chord table in the present embodiment. In the non-determination chord table 2600 shown in FIG. 26, a certain value corresponding to the set of Current Melody tone CM and Previous Chord name PreCH can be obtained.

In the non-determination chord table 2600, blank columns (for instance, refer to Reference numeral: 2601) mean that Current Melody Function CMF corresponding to the set of Current Melody tone CM and Previous Chord name PreCH is Chord Tone "CT" or Scale Note "SN" (Refer to FIG. 25). Concerning the sets of Current Melody tone CM and Previous Chord name PreCH corresponding to the blank columns in the non-determination chord table 2600, Current Chord name CurCH does not take a non-determination chord and therefore its value is not stored in the table. In the case that Current Melody Function "CMF" is Other Tone "OT", information designating either Diminish "dim" or Augment "aug" is stored in the non-determination chord table 2600.

From the non-determination chord table 2600, CPU 21 obtains information designating either Diminish "dim" or Augment "aug" corresponding to the set of Current Melody tone CM and Previous Chord name PreCH, obtaining a chord name with the root note of Current Melody tone CM. For example, if a current melody tone is "C♯" and a previous chord name is "Imaj", then the chord name will be "I♯dim" (Refer to Reference numeral: 2611). Further, if a current melody tone is "A♭" and a previous chord name is "IM7", then the chord name will be "IV♭aug". CPU 21 decides the chord name of Diminish "dim" or Augment "aug" with the root note of Current Melody tone CM as Current Chord name CurCH and stores the decided chord name in RAM 23.

As described above, in the present embodiment, Current Melody tone CM relating to a key depressed at the leading position of the current beat and Previous Melody tone PM relating to a key depressed at the leading position of the previous beat are modified based on the information indicating the beat number, Previous Chord name PreCH and a key depressing timing (steps 501 to 510 in FIG. 5). And then, Current Melody tone CM is decided based on Previous Melody tone PM and Previous Chord name PreCH (step 511).

Figure 27:
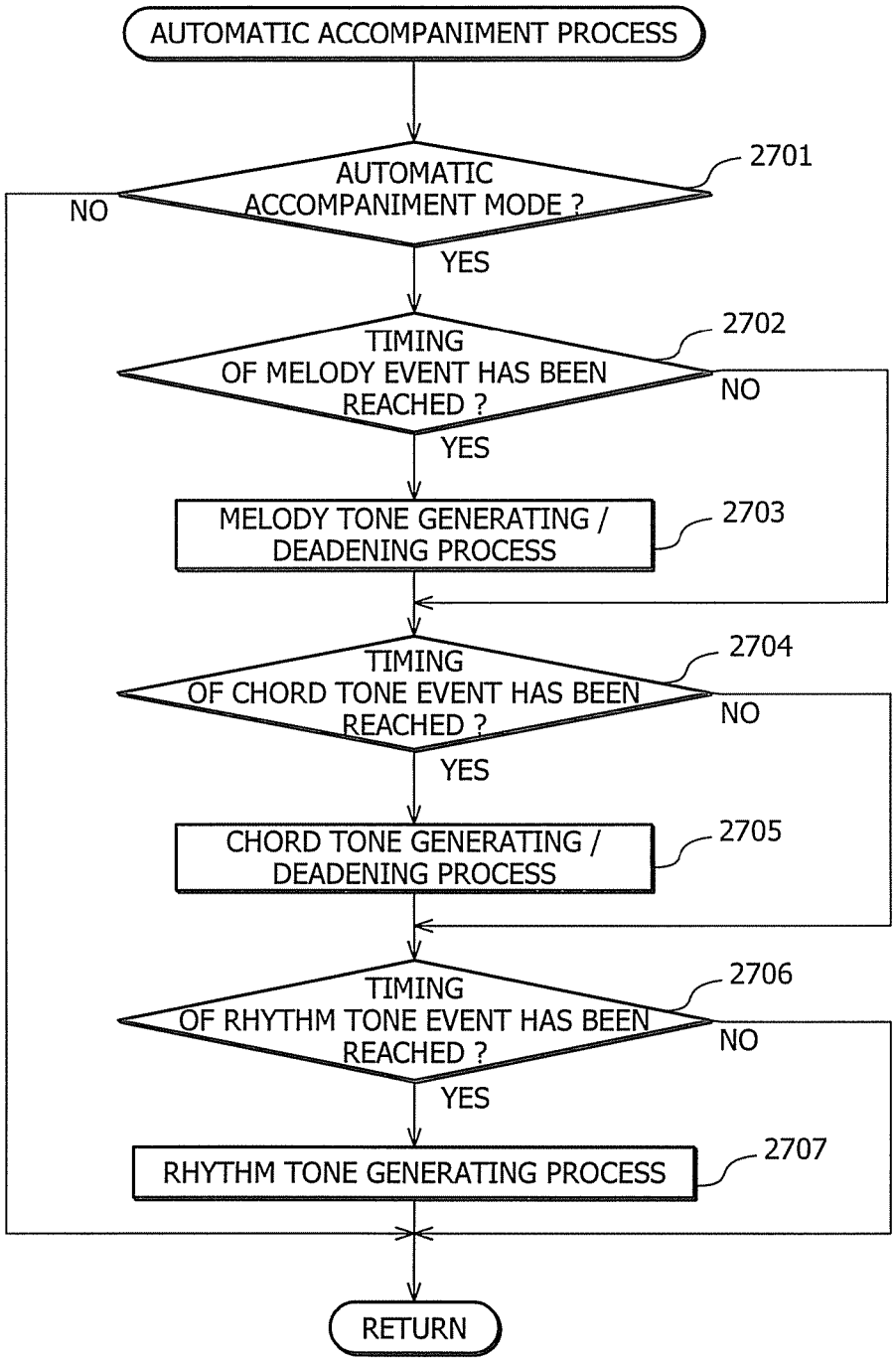
FIG. 27 is a flow chart of an example of a flow chart of an automatic accompanying process in the present embodiment.

After the chord name determining process has been performed at step 304 in FIG. 3, CPU 21 performs an automatic accompaniment process at step 305. FIG. 27 is a flow chart of an example of a flow chart of the automatic accompaniment process in the present embodiment. CPU 21 judges at step 2701 whether or not the electronic musical instrument 10 is operating in an automatic accompaniment mode. When it is determined YES at step 2701, CPU 21 refers to a timer (not shown), judging whether or not the current time has reached a performance timing of performing an event of melody-tone data in automatic accompaniment data (step 2702).

The automatic accompaniment data comprises three sorts of musical tones, that is, data of melody tones (including an obbligato), data of chord tones and data of rhythm tones. The data of melody tones and data of chord tones contain a pitch, sounding timing and sounding duration of each musical tone to be generated. The data of rhythm tones contains a sounding timing of each musical tone to be generated.

When it is determined YES at step 2702, CPU 21 performs a melody tone generating/deadening process at step 2703. In the melody tone generating/deadening process, CPU 21 judges whether or not the related event is a note-on event. When the current time substantially coincides with the sound generating timing of a certain musical tone in the melody tone data, it can be decided that the event to be processed is a note-on event. Meanwhile, when the current time substantially coincides with a time at which the sounding duration has already lapsed from the tone generating timing of the musical tone, it can be decided that the event to be processed is a note-off event.

When the event to be processed is a note-off event, CPU 21 performs the tone deadening process. Meanwhile, the event to be processed is a note-on event, CPU 21 performs the tone generating process in accordance with the melody tone data.

CPU 21 refers to the timer (not shown), judging whether or not the current time has reached a timing of an event performance of chord tone data in the automatic accompaniment data (step 2704). When it is determined YES at step 2704, CPU 21 performs at step 2705 a chord tone generating/deadening process. In the chord tone generating/deadening process, a chord tone is subjected to the tone generating process, when the tone generating timing of the chord tone has been reached. Meanwhile, the chord tone is subjected to the tone deadening process, when the tone deadening timing of the chord tone has been reached.

Then, CPU 21 judges at step 2706 whether or not the current time has reached a timing of an event performance of rhythm data in the automatic accompaniment data. When it is determined YES at step 2706, CPU 21 performs at step 2707 a rhythm tone generating process. In the rhythm tone generating process, when the tone generating timing of a rhythm tone has been reached, a note-on event of such rhythm tone is generated.

When the automatic accompaniment process finishes at step 305 in FIG. 3, CPU 21 performs the sound-source sound generating process at step 306. In the sound-source sound generating process, CPU 21 supplies the sound source unit 26 with data indicating timbre and pitches of musical tones to be generated or data indicating timbre and pitches of musical tones to be deadened. The sound source unit 26 reads waveform data from ROM 22 in accordance with data indicating timbre, pitches, tone durations, generating certain musical tone data. CPU 21 gives the sound source unit 26 an instruction of deadening a tone of the pitch indicated by the note-off event.

When the sound-source sound generating process finishes at step 306, CPU 21 performs other process, displaying an image on the displaying unit 15, turning on or off LED (not shown) (step 307), and then returns to step 302.

In the chord name determining process (step 304 in FIG. 3) in the present embodiment, CPU 21 determines Current Melody tone CM of a key depressed at the leading position of the current beat and Previous Melody tone PM of a key depressed at the leading position of the beat just prior to the current beat, based on time information (in particular, beat information) of controlling progression of the automatic accompaniment data in the melody sequence progressing in response to key operation on the key board 11. Further, based on the determined Current Melody tone CM, Previous Melody tone PM, and Previous Chord name PreCH or the chord name at the previous beat, CPU 21 performs the process of deciding the chord name (step 511 in FIG. 5) to decide the Current Chord name CurCH. When deciding a melody tone, CPU 21 determines Current Melody tone CM and Previous Melody tone PM based what number of beat in a measure the current beat corresponds to.

In short, in the present embodiment, in consideration of the temporal position at which a key is depressed, Current Melody tone PM and Previous Melody tone PM are determined, and based on the sequence of the determined melody tones and Previous Chord name PreCH, Current Chord name CurCH is determined.

In the present embodiment, in the case that the beat is a four time, CPU 21 determines information of the current melody-tone and information of the previous melody-tone based on whether the current beat corresponds to the first beat or third beat or whether the current beat corresponds to other beat. In other words, Current Melody tone CM and Previous Melody tone PM are determined based on downbeats (first beat, third beat) and upbeats (second beat, fourth beat), and it is possible to place emphasis on beats.

In the present embodiment, in the case that a tone of a key depressed at the leading position or thereafter extends to the current beat, CPU 21 determines that the key corresponds to syncopation, and gives a tone relating to the key corresponding to syncopation to Current Melody tone CM. In other words, when syncopation is established, even if a key has not been depressed at the leading position of a beat, the key can be treated as if such key is depressed at the leading position of a beat.

In the first dominant motion determining process (FIG. 10), when Previous Chord name PreCH indicates a dominant chord, and a transition from Previous Melody tone PM to Current Melody tone CM indicates a predetermined transition form a composing tone of a dominant chord to a composing tone of a tonic chord, CPU 21 gives a chord name corresponding to the tonic to Current Chord name CurCH. In this way, when the dominant motion is clearly represented in the melody sequence, Current Chord name CurCH is set as the tonic to terminate the chord progression.

In the second dominant motion determining process (FIG. 17), when a transition from Previous Melody tone PM to Current Melody tone CM indicates a predetermined transition form a composing tone of a dominant chord to a composing tone of a tonic chord, CPU 21 gives a chord name corresponding to the tonic to Current Chord name CurCH. Even if Previous Chord name PreCH is not a dominant chord, when the dominant motion is clearly represented in the melody sequence, Current Chord name CurCH is set as the tonic to terminate the chord progression.

In the first dominant motion determining process, or in the second dominant motion determining process, when the chord name corresponding to the tonic has not been given to Current Chord name CurCH, Previous Chord name PreCH is given to Current Chord name, whereby a chord is held.

The electronic musical instrument 10 according to the present embodiment is provided with the first and second chord table. In the first chord table, chord names are stored, which are associated with Previous Melody tone PM, Current Melody tone CM and Previous Chord name PreCH, when Current Melody tone CM relates to a key depressed at the first beat. In the second chord table, chord names are stored, which are associated with Previous Melody tone PM, Current Melody tone CM and Previous Chord name PreCH, when Current Melody tone CM relates to a key depressed at a beat other than the first beat. CPU 21 refers to the first or second chord table depending on the key depressing timing, whereby CPU 21 is allowed to obtain a chord name in accordance with the beat. Further, CPU 21 can decide the chord name in real time, by referring to these chord tables.

In the present embodiment, if a chord name corresponding to the determined Previous Melody tone PM and Current Melody tone CM is not found in the first or second chord table, the non-determination chord such as Augment "aug" or Diminish "dim" is given to Current Chord name CurCH. Even if Previous Melody tone PM and Current Melody tone CM are not a chord composing tone or scale note, some sort of reasonable chord name can be given in a musical piece.

In the present embodiment, it is possible for CPU 21 by referring to the non-determination table to determine depending on Previous Melody tone PM, Current Melody tone CM and Previous Chord name PreCH, which chord should be given to Present Chord name PreCH, Augment "aug" or Diminish "dim".

Although specific embodiments of the present invention have been illustrated in the accompanying drawings and described in the detailed description, it will be understood that the invention is not limited to the particular embodiments described herein, but modifications and variations may be made to the disclosed embodiments while remaining within the scope of the invention as defined by the following claims.

For instance, an example of a musical piece in four time has been described in the present embodiment, but the present invention can be applied to a musical piece in triple time or six time. For instance, in the case of the musical piece in triple time, processes with respect to the first to third beat should be used. In the case of the musical piece in six time, it is considered that the case of triple time is doubled, and the processes for the first to third beat are used. And processes for fourth to sixth beat are treated in the same manner as the processes for the first to third beat.

In the aforesaid embodiments, in the case of the tonality of C major (Cmaj) or A minor (Amin), a chord name using the degree corresponding to the tonic (root note) is obtained, but invention is not limited to the tonality of C major (Cmaj) or A minor (Amin). The invention may be applied to other tonality. In this case, for instance, if the musical piece is major, a pitch difference between the note of "C" and the root note of the tonality of the musical piece is calculated, and the calculated pitch difference is used as an offset value or discrepancy, and stored in RAM 23. In the process, the tone name specified by the key number of the depressed key is decreased by the offset value or discrepancy, and the process can be performed at the scale of "C".

What is claimed is:

1. An automatic accompanying apparatus comprising:

storing means for storing automatic accompanying data, wherein the automatic accompanying data includes at least chord names and tone producing timings of chord composing tones based on time information containing beats;

musical-tone generating means for generating musical-tone data of a musical piece;

musical-tone data controlling means for controlling the musical-tone generating means in response to manipulation of a performance device; and chord name determining means for determining a chord name for generating musical tones in accordance with the automatic accompanying data, based on manipulation of the performance device, wherein the chord name determining means further comprises:

melody tone deciding means for deciding information of a current melody tone and information of a previous melody tone, based on time information for defining progression of the automatic accompanying data in operation in a melody sequence, which progresses in response to manipulation of the performance device, wherein the current melody tone relates a key depressed at a leading position of a current beat and the previous melody tone relates a key depressed at a leading position of a previous beat directly prior to the current beat; and chord name deciding means for deciding information of a current chord name based on the information of a current melody tone and the information of a previous melody tone, which have been decided by the melody tone deciding means, and information of a previous chord name at the previous beat, wherein the melody tone deciding means decides the information of a current melody tone and the information of a previous melody tone based on what number the current beat is in a measure.

2. The automatic accompanying apparatus according to claim 1, wherein the time information contains information of time in music, and the melody tone deciding means decides the information of a current melody tone and the information of a previous melody tone based on whether the current beat is the first beat or the third beat or whether the current beat is a beat other than the first and third beat, when the time information indicates that time in music is a quadruple time.

3. The automatic accompanying apparatus according to claim 2, wherein the melody tone deciding means decides that rhythm is syncopation, when a tone of a key depressed after the leading position of a previous beat extends to the current beat, and decides that the information of a current melody tone relates to the depressed key whose tone extends to the current beat.

4. The automatic accompanying apparatus according to claim 3, wherein, the chord name deciding means comprises a first dominant motion determining means, which gives a chord name corresponding to a tonic to the information of a current chord name, when the information of a previous chord name indicates a dominant chord, and transition from a tone indicated in the information of a previous melody tone to a tone indicated in the information of a current melody tone indicates predetermined transition from a composing tone of a dominant chord to a composing tone of a tonic chord.

5. The automatic accompanying apparatus according to claim 3, wherein, the chord name deciding means comprises a second dominant motion determining means, which gives a chord name corresponding to a tonic to the information of a current chord name, when transition from a tone indicated in the information of a previous melody tone to a tone indicated in the information of a current melody tone indicates predetermined transition from a composing tone of a dominant chord to a composing tone of a tonic chord.

6. The automatic accompanying apparatus according to claim 5, wherein, the chord name deciding means gives the information of a previous chord name to the information of a current chord name, when no chord name corresponding to a tonic has been given to the information of a current chord name from the first dominant motion determining means or from the second dominant motion determining means.

7. The automatic accompanying apparatus according to claim 6, further comprising:

a first chord table and a second chord table; wherein the first chord table stores chord names associated with the information of a previous melody tone, the information of a current melody tone and the information of a previous chord name, in the case that the information of a current melody tone relates to a key depressed at the first beat, and the second chord table stores chord names associated with the information of a previous melody tone, the information of a current melody tone and the information of a previous chord name, in the case that the information of a current melody tone relates to a key other than the key depressed at the first beat, and wherein the chord name deciding means refers to the first chord table to obtain a chord name, deciding the obtained chord name as the information of a current chord name, in the case that the information of a current melody tone relates to a key depressed at the first beat, and refers to the second chord table to obtain a chord name, deciding the obtained chord name as the information of a current chord name, in the case that the information of a current melody tone relates to a key other than the key depressed at the first beat.

8. The automatic accompanying apparatus according to claim 7, wherein the first chord table and the second chord table store chord names associated with predetermined information of a previous melody tone, predetermined information of a current melody tone and the information of a previous chord name, and the chord name deciding means comprises non-determination chord giving means for giving a non-determination chord name to the information of current chord name, based on the information of a previous melody tone and the information of a current melody tone decided by the melody tone deciding means, when a corresponding chord name has not been found in the first chord table and the second chord table.

9. The automatic accompanying apparatus according to claim 8, further comprising:

a non-determination chord table storing chord names corresponding to non-determination chords indicating augment or diminish, associated with other information of a previous melody tone, other information of a current melody tone and information of a previous chord name, wherein the other information of a previous melody tone and the other information of a current melody tone are not associated with chord names in the first chord table and the second chord table, wherein the non-determination chord giving means refers to the non-determination chord table based on the information of a previous melody tone and the information of a current melody tone decided by the melody tone deciding means to obtain a chord name of the non-determination chord, giving the obtained chord name of the non-determination chord to the information of a current chord name.

10. A computer readable recording medium to be mounted on an apparatus, wherein the apparatus is provided with a computer, a storing unit, which stores automatic accompanying data including at least chord names and tone producing timings of chord composing tones based on time information containing beats, and a musical-tone generating unit for generating musical-tone data of a musical piece, the recording medium storing a computer program, when executed, to make the computer perform the steps of:

musical-tone data controlling step of controlling the musical-tone generating unit in response to manipulation of a performance device; and chord-name determining step of determining a chord name for producing musical tones in accordance with the automatic accompanying data, in response to manipulation of the performance device, wherein the chord-name determining step further comprises:

melody tone deciding step of deciding information of a current melody tone and information of a previous melody tone, based on time information for defining progression of the automatic accompanying data in operation in a melody sequence, which progresses in response to manipulation of the performance device, wherein the current melody tone relates a key depressed at a leading position of a current beat and the previous melody tone relates a key depressed at a leading position of a previous beat directly prior to the current beat; and chord-name deciding step of deciding information of a current chord name based on the information of a current melody tone and the information of a previous melody tone, decided in the melody tone deciding step, and information of a previous chord name at the previous beat, wherein in the melody tone deciding step, the information of a current melody tone and the information of a previous melody tone are decided based on what number the current beat is in a measure.

* * * * *